US005860704A

United States Patent [19]

Smith

[11] Patent Number: 5,860,704

[45] Date of Patent: Jan. 19, 1999

[54] FURNITURE CONSTRUCTION WITH RIGID FOLDABLE MATERIAL

[75] Inventor: E. Dallas Smith, Indianapolis, Ind.

[73] Assignee: DBX Engineering Corporation, Indianapolis, Ind.

[21] Appl. No.: 855,296

[22] Filed: May 13, 1997

[51] Int. Cl.[6] ..... A47C 7/00

[52] U.S. Cl. ..... 297/440.12; 297/440.1

[58] Field of Search ..... 297/440.12, 440.1; 248/152, 174

[56] References Cited

U.S. PATENT DOCUMENTS

| | | | |
|---|---|---|---|
| 2,707,514 | 5/1955 | Smith | 297/411.27 |
| 2,806,514 | 9/1957 | Smith | 297/440.12 |
| 2,955,647 | 10/1960 | Smith | 297/440.12 |
| 3,331,634 | 7/1967 | Harrison, Jr. . | |
| 3,695,703 | 10/1972 | Notko . | |
| 3,717,377 | 2/1973 | Johnson . | |
| 4,085,970 | 4/1978 | Klein . | |
| 4,340,251 | 7/1982 | Geoffroy-Dechaume . | |
| 5,580,131 | 12/1996 | Ribot . | |

*Primary Examiner*—Milton Nelson, Jr.
*Attorney, Agent, or Firm*—Woodard, Emhardt, Naughton, Moriarty & McNett

[57] ABSTRACT

Chairs constructed of fiberboard with an easily assembled core structure, reinforced arms, and an outer casing that economically consumes raw sheeting material by minimizing stamping waste. The chairs include a casing, a core structure, and a body panel. The core is built from aligned L-shaped members and transverse struts that mutually connect by interfitting slots. The casing is built from a rectangular tube. The tube has side sections, a front section and a rear section. For the versions with arms, the side sections carry flaps that reinforce the arm areas. For the versions without arms, the side sections carry flaps that fold over the L-shaped members. The body panel resides over the back support area and the seat support area of the L-shaped members and provides a uniformly smooth surface. The chairs may be combined or aligned in series to form a sectional couch.

33 Claims, 19 Drawing Sheets

FURNITURE CONSTRUCTION WITH RIGID FOLDABLE MATERIAL

This invention relates generally to the construction of furniture, and more particularly relates to the construction of furniture from lightweight rigid material, such as fiberboard or cardboard.

BACKGROUND OF THE INVENTION

I am aware of three patents that are relevant background to the invention that I now disclose in this patent. The earliest of these is U.S. Pat. No. 2,707,514, which was awarded to me in 1955. That patent disclosed a chair made of cardboard that was largely held together with staples or tape. Unlike the chairs in this patent, that chair was not designed to minimize or eliminate the need for these attachments.

The second is U.S. Pat. No. 2,806,514, which was awarded to me in 1957. The chair in that patent had a core structure that was somewhat difficult for some consumers to build. Its struts required folding before they were inserted into mating web members. Additionally, my experience has shown that the casing around the arms of that chair needed additional support and that the blank used to make that particular chair left behind not insignificant amounts of waste.

The last of the three background patents is U.S. Pat. No. 2,955,647, which was awarded to me in 1960. Similar to the above-described patent, my experience in this technology has again shown that the casing around the arms of that chair could benefit from additional support and that the blank used to make that chair left behind unnecessary waste. Furthermore, a problem common to this and all these earlier designs was excessive squeaking during use.

Therefore, what is needed is a chair that is simple for the average person to assemble, has less waste during large scale production, has additional support in its arms, and finally, is designed to reduce or prevent the material of construction from squeaking when the chair is used. My invention that is described in this patent addresses these needs.

SUMMARY OF THE INVENTION

One aspect of my invention is an article of furniture that includes a casing structure, a core structure, and a body panel. The core structure is built from aligned, spaced, and generally L-shaped members as well as transverse struts that extend between the L-shaped members. The L-shaped members interfit with the transverse struts by mutually engaging slots. The base legs of the L-shaped members provide a seat support area and the extending legs of the L-shaped members provide a back support area.

The casing structure is built from a generally rectangular tube that is folded from a blank of stiff sheet material. The rectangle has two side sections, a front section, and a rear section with each section carrying at its lower margin a base panel that folds into overlapping relation with the others to close the base of the casing structure. The core structure is then accommodated within the casing structure.

The rear section carries at its upper margin a first flap with three lines of spaced parallel transverse score lines. The first flap folds inwardly at each of these score lines and interfits with the core structure by mutually engaging slots.

The front section carries at its upper margin a second flap with two lines of spaced parallel transverse score lines. The second flap folds inwardly at each of these score lines and interfits with the core structure by mutually engaging slots.

The side sections carry at their upper margins a seat flap and a back flap. These flaps respectively fold over the base legs and the extending legs of the L-shaped members.

The body panel resides over the back support area and the seat support area. The body panel carries upper and lower flaps with a score line that divides the flaps from the remainder of the panel. The upper and lower flaps fold inwardly along these score lines and interfit with the core structure by mutually engaging slots.

The lubricant is preferably placed on all of the above structures and minimally, when used, is placed upon at least one of them.

Another aspect of my invention is an article of furniture that includes a casing structure, a core structure, a body panel, and two side panels. The core structure is built from aligned, spaced, generally L-shaped members and transverse u-shaped struts that extend between the L-shaped members. The L-shaped members interfit with the transverse u-shaped struts by mutually engaging slots. The base legs of the L-shaped members provide a seat support area and the extending legs of said L-shaped members provide a back support area.

The casing structure is built from a generally rectangular tube that is folded from a blank of stiff sheet material. The rectangle has two side sections, a front section and a rear section, with each section carrying at its lower margin a base panel that folds into overlapping relation with the others to close the base of the casing structure. The core structure is then accommodated within the casing structure.

The rear and side sections carry at their upper margins respectively a first flap and two side flaps. Each of these flaps have three lines of spaced parallel transverse score lines. Each of these flaps folds inwardly at each of their score lines and interfits with the core structure by mutually engaging slots.

The front section carries at its upper margin a second flap with two lines of spaced parallel transverse score lines. The second flap folds inwardly at each of these score lines and interfits with the core structure by mutually engaging slots.

The body panel resides over the back support area and the seat support area. The body panel carries upper and lower flaps with a score line that divides the flaps from the remainder of the panel. The upper and lower flaps fold inwardly at each of these score lines and interfit with the core structure by mutually engaging slots.

The side panels are positioned over the internal side of the extending legs of the unshaped members and are laid over the seat support area.

Yet another aspect of my invention is an article of furniture that includes a casing structure, a core structure, a body panel, and a side panel. The core structure is built from aligned, spaced, generally L-shaped members and transverse L-shaped struts that extend between the L-shaped members. The L-shaped members interfit with the transverse L-shaped struts by mutually engaging slots. The base legs of the L-shaped members provide a seat support area and the extending legs of the L-shaped members provide a back support area.

The casing structure is built from a generally rectangular tube that is folded from a blank of stiff sheet material. The rectangle has two differing side sections, a front section and a rear section, with each section carrying at its lower margin a base panel that folds into overlapping relation with the others to close the base of the casing structure. The core structure is then accommodated within the casing structure.

The rear and one side section carry at their upper margins respectively a first flap and a side flap. Each of these flaps have three lines of spaced parallel transverse score lines. Each of these flaps folds inwardly at each of their score lines and interfits with the core structure by mutually engaging slots.

The other side section carries at its upper margin a seat flap. This flap folds over the base of the L-shaped members.

The front section carries at its upper margin a second flap with two lines of spaced parallel transverse score lines. The second flap folds inwardly at each of these score lines and interfits with the core structure by mutually engaging slots.

The body panel resides over the back support area and the seat support area. The body panel carries upper and lower flaps with a score line that divides the flaps from the remainder of the panel. The upper and lower flaps fold inwardly at each of these score lines and interfit with the core structure by mutually engaging slots.

The side panel is positioned over the internal side of the extending legs of the L-shaped members and is laid over the seat support area.

An object of my invention to provide a better chair structure that can be shipped or stored in a relatively small flat container and which can be assembled after removal from the container without tools, adhesives, or staples.

A further object of this invention is to provide a chair that is light in weight, yet is rigid and sturdy.

Another object of this invention is to provide a chair that does not squeak during use.

Still a further object of this invention is to provide a chair that has minimal waste in mass production And another object of this invention is to provide a chair with no arms and a chair with one arm, so that one may form a sectional couch by placing multiple units side-by-side.

And finally, still a further object of this invention is to provide a chair that has better arm support than fiberboard chairs described in the prior art.

BRIEF DESCRIPTION OF THE DRAWINGS

The nature of my invention can be understood from the attached drawings and the detailed description of the preferred examples that follow. To assist the reader, I use the same numbers in the drawings to identify the same or similar structures from one drawing to the next. A complete copy of my patent has 22 figures, in which.

DESCRIPTION OF THE PREFERRED EMBODIMENTS

I use specific language in the following description to promote a thorough understanding of my invention. I use this description to publicly disclose my invention and to convey an understanding of its principles. But please understand that I intend no limits on the breadth of my patent rights based simply on my use of this specific language. I also include in my rights any alterations and modifications to my descriptions and drawings that should normally occur to one of average skill in this technology.

I use the terms "scored" and "fold lines" interchangeably in this patent to generally describe a location that has been prefolded or marked with lines, grooves, scratches, or notches.

Figure 1:
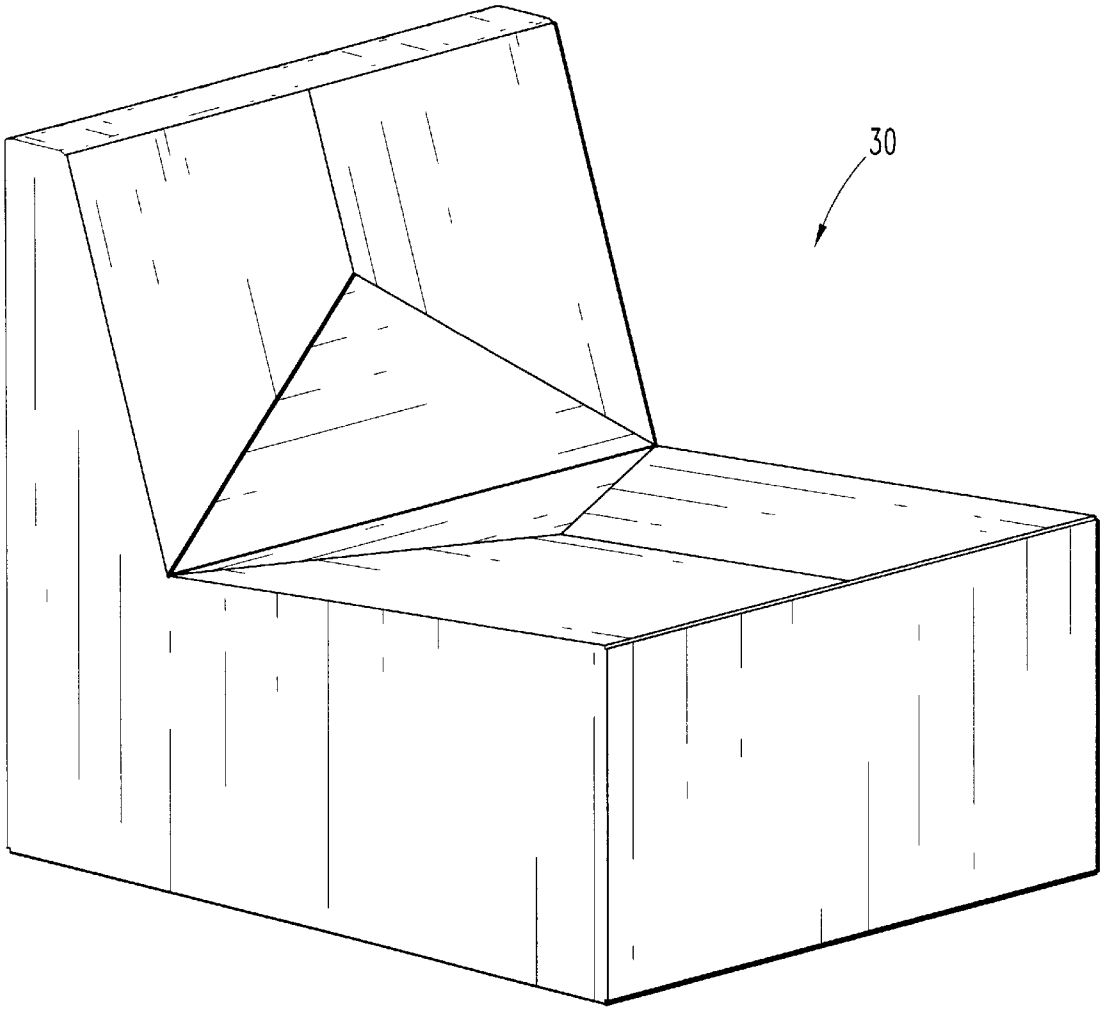
FIG. 1 is a perspective view of a completed example of my invention without arms.

Referring to FIG. 1, chair 30 is shown as an example of my invention. The construction of chair 30 begins with blank 31, shown in FIG. 2. Blank 31 folds along fold lines 32, 33, 34 and 35 to form a tube. Simultaneously referring to FIG. 4, the tube is generally rectangular and is formed of side sections 36 and 37, rear section 38 and front section 39. The integrity of the tube is maintained by attaching tab 36*e* to free edge 40, on rear section 38, with glue, staples, or anything known in this technology that binds the particular material. This attachment is preferably made before continuing further assembly or placed in storage by the consumer.

I prefer that blank 31 is also triple scored for folding at 41 and 42. Three score lines in both front section 39 and rear section 38 allow the chair to be stored flat by folding it along the triple score lines and compressing the rectangle. It is better to bend the rectangle at the triple score lines, rather than fold lines 32, 33, 34 or 35, because these later fold lines are preferably not bent to a point more than 90 degrees from their original flat stamping.

Overlapping and interlocking four panels at the lower margin of blank 31 closes the bottom of chair 30. For example, referring to FIGS. 2 and 4, front section 39 is scored along 45 to create panel 39*a* and is further scored along 46 to create panel 39*b*. The marginal area of panel 39*b* has a series of slots, generally identified at 49. These slots are provided to hold the core structure of chair 30, described below. Panel 39*b* is bent inwardly along score line 46 to a point that is perpendicular to panel 39*a*. Panel 39*a* is then placed in position by bending panel 39*a* inwardly along score line 45 to a point that is perpendicular to front section 39.

Figure 2:
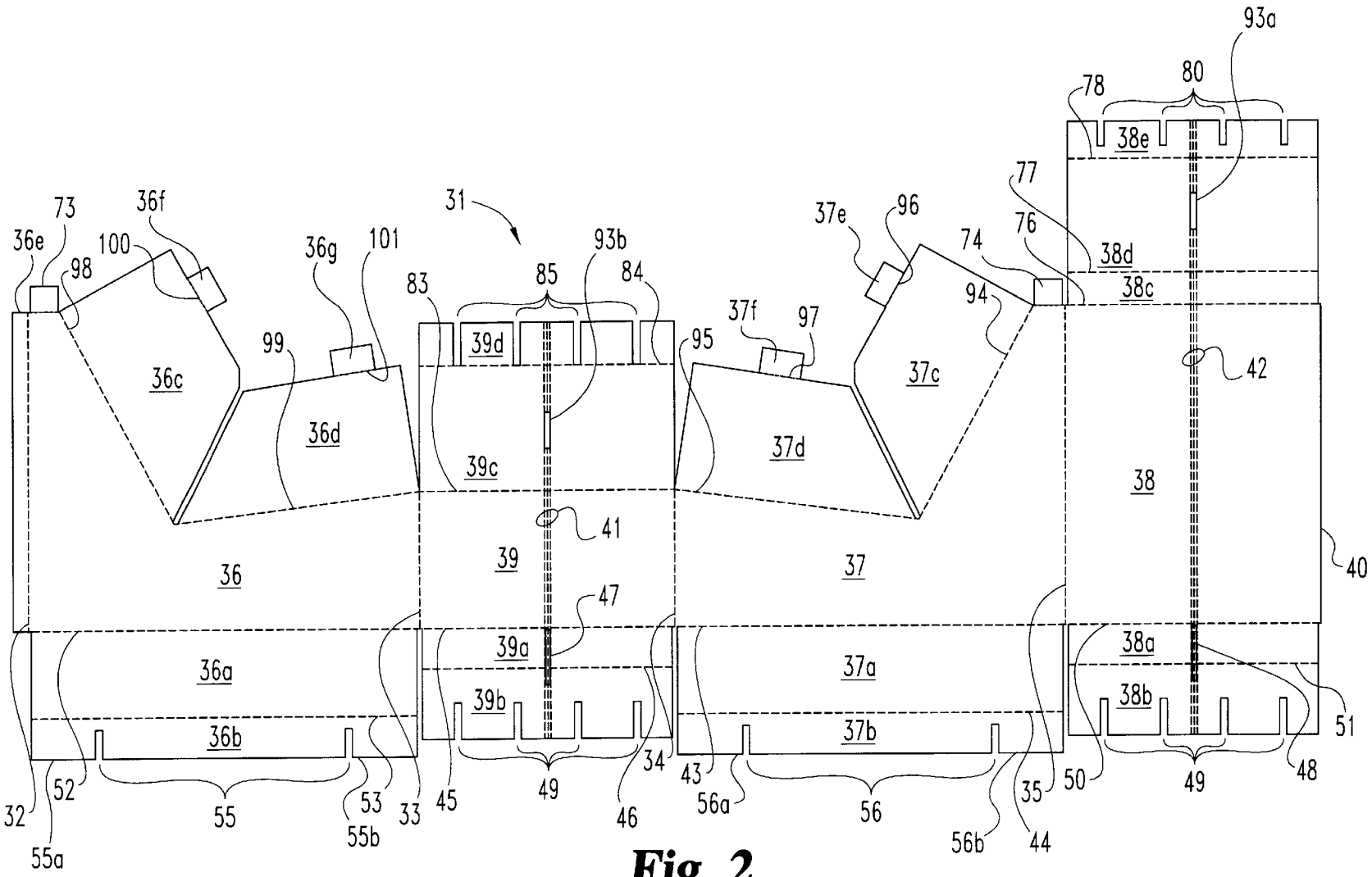
FIGS. 2, 3, 6 and 7 are plan views of the blanks that are cut, scored (dashed lines), and ready for assembly to create the chair shown in FIG. 1.

Referring to FIG. 2, the lower portion of rear section 38 is similarly scored as front section 39. Rear section 38 is scored at 50 to create panel 38*a* and at 51 to create 38*b*. Panel 38*b* is bent inwardly along score line 51 to a point that is perpendicular to panel 38*a*. Panel 38*a* is then placed in position by bending panel 38*a* inwardly along score line 50 to a point that is perpendicular to rear section 38.

Figure 4:
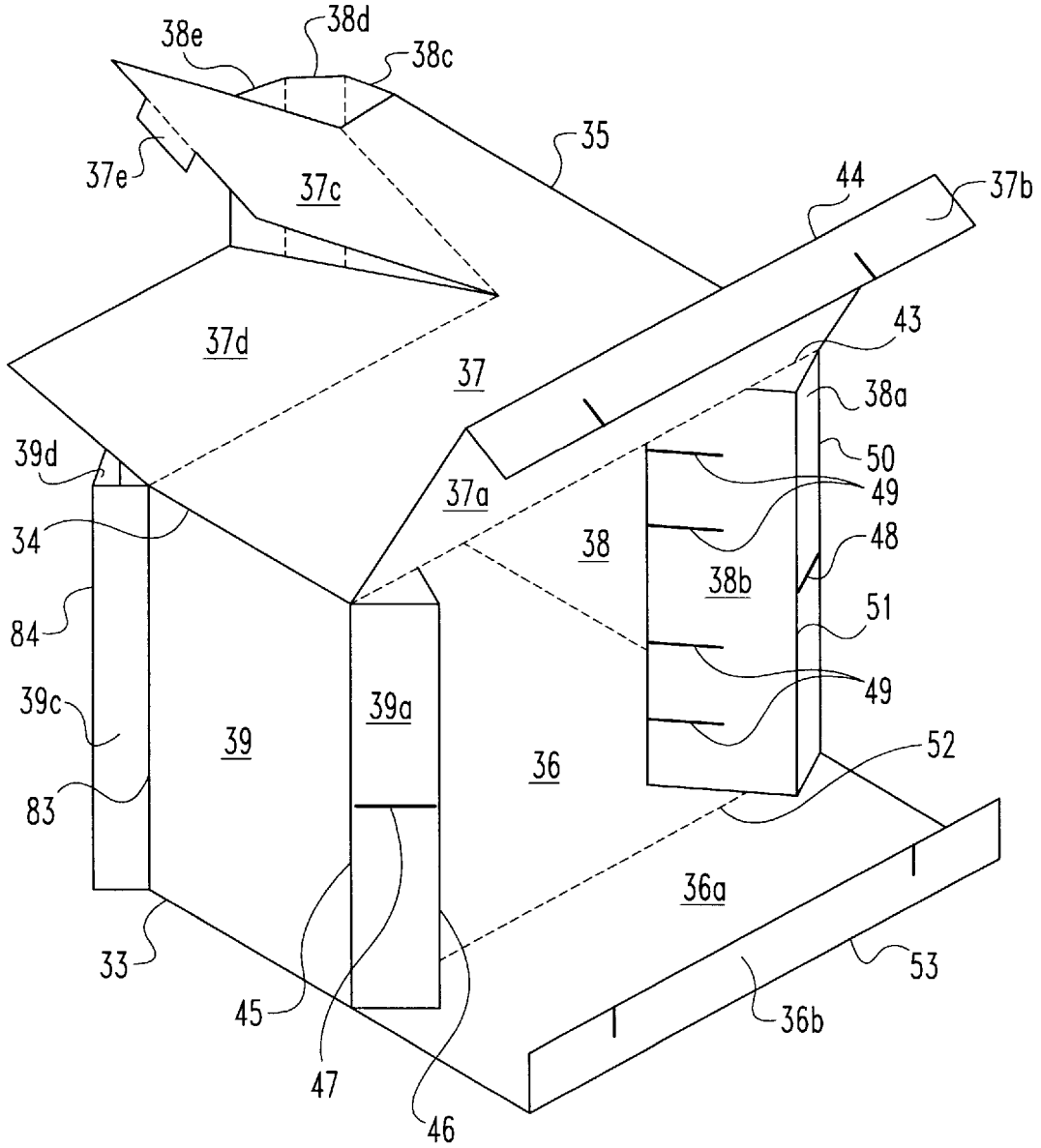
FIG. 4 is a perspective view of a partially folded casing structure.

The two remaining bottom panels are located at the lower portions of side sections 36 and 37. Referring to FIGS. 2 and 4, side section 36 is scored along 52 to create panel 36*a* and is further scored along 53 to create panel 36*b*. The marginal area of panel 36*b* has two slots, generally identified at 55. To the outside of slots 55 are lateral tabs 55*a* and 55*b*. Panel 36*b* is bent inwardly along score line 53 to a point that is perpendicular to panel 36*a*. Panel 36*a* is then bent inwardly along score line 52 to a point that is perpendicular to side section 36. In so doing, lateral tab 55*a* is inserted into slot 48 of panel 38*a* and lateral tab 55*b* is inserted into slot 47 of panel 39*a*.

Still referring to FIG. 2, the last panel needed to close the bottom of chair 30 is found in the lower portion of side section 37. Side section 37 is similarly scored as side section 36. Side section 37 is scored at 43 to create panel 37*a* and at 44 to create 37*b*, and furthermore, has two slots 56 that create lateral tabs 56*a* and 56*b*. Panel 37*b* is bent inwardly along score line 44 to a point that is perpendicular to panel 37*a*. Panel 37*a* is then bent inwardly along score line 43 to a point that is perpendicular to side section 37. In so doing, lateral tab 56*b* is inserted into slot 48 of panel 38*a* and lateral tab 56*a* is inserted into slot 47 of panel 39*a* to close the bottom of chair 30.

Figure 6:
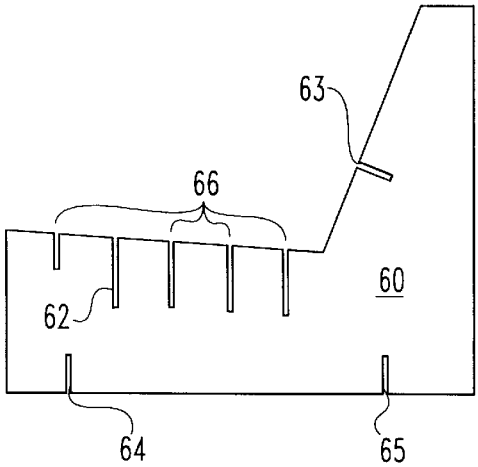
Figure 7:
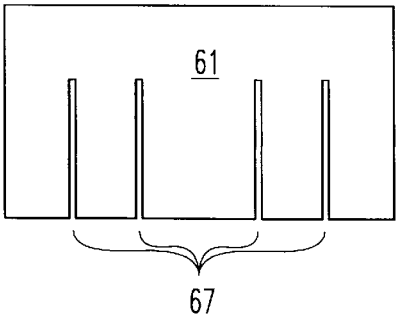
Figure 5:
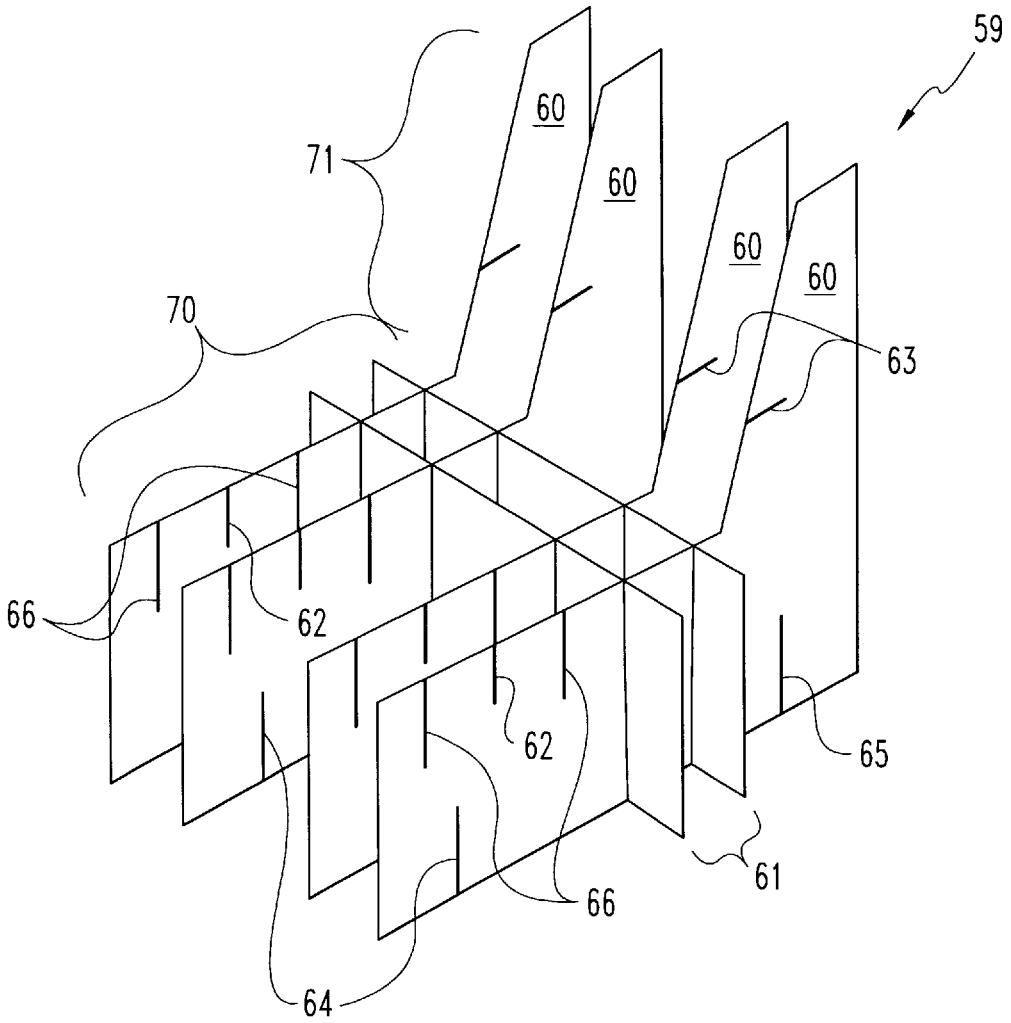
FIG. 5 is a perspective view of a partially completed core structure.

An example of the core structure for chair 30 is shown in FIG. 5 and is generally identified as item 59. It includes aligned, spaced, and generally L-shaped members 60, shown in isolation in FIG. 6. Members 60 are held apart and supported by struts 61, shown in isolation in FIG. 7. FIG. 5 shows two of the struts removed from core structure 59 in order to convey construction details. Struts 61 have a series of slots, generally identified at 67. Referring back to FIG. 5, members 60 interfit with struts 61 by placing struts 61 transverse to members 60 and mutually engaging slots 66 in L-shaped members 60 with slots 67 in struts 61. Thusly held, the base legs of members 60 provide a chair seat support area, area 70, and the extending legs of members 60 provide a chair back support area, area 71. Preferably, each strut gradually increases in height to a point even with the L-shaped members as you move toward the front of the chair. This provides added stability.

The assembly of the chair continues by placing core structure 59 within the casing structure. The casing structure is formed from blank 31 with its bottom closed as described earlier. Core structure 59 is then placed or assembled inside the casing structure with the extending legs of members 60 placed against rear section 38 of the casing structure. If preassembled, the core structure 59 is slowly lowered and slots 64 and 65 in L-shaped members 60 are mutually engaged with slots 49, which are located within panels 38*b* and 39*b*. The construction of chair 30 to this point is shown in FIG. 8.

Next, the top of chair 30 is closed. Referring to FIGS. 2 and 8, tabs 73 and 74 are first folded over core structure 59 which is followed by folding the remainder of rear section 38 into place. Rear section 38 is scored at 76 to create panel 38*c*, is scored at 77 to create panel 38*d*, and is scored at 78 to create panel 38*e*. The marginal area of panel 38*e* has a series of slots, generally identified at 80. These slots are provided to engage core structure 59. Panel 38*e* is first bent inwardly along score line 78 to a point that is nearly perpendicular to panel 38*d*. Next, panel 38*d* is bent inwardly along score line 77 to a point that is nearly perpendicular to panel 38*c*. Panel 38*c* is then bent inwardly along score line 76 to a point that is perpendicular to rear section 38. In so doing, panel 38*e* interfits with core structure 59 by mutually engaging slots 80 with slots 63 in L-shaped members 60.

Figure 8:
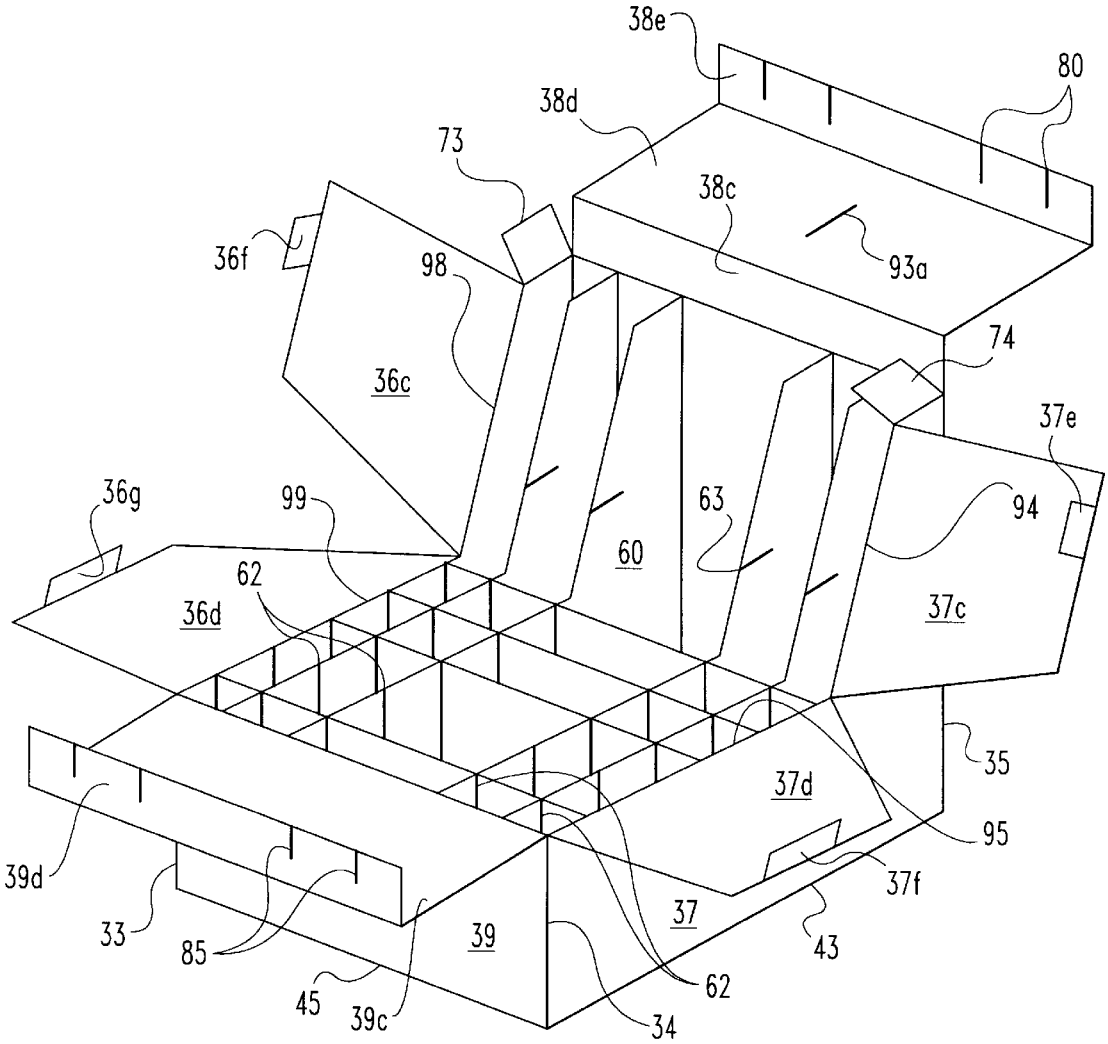
FIGS. 8, 9 and 10 are perspective views of the partially completed chair that is shown in FIG. 1.
Figure 9:
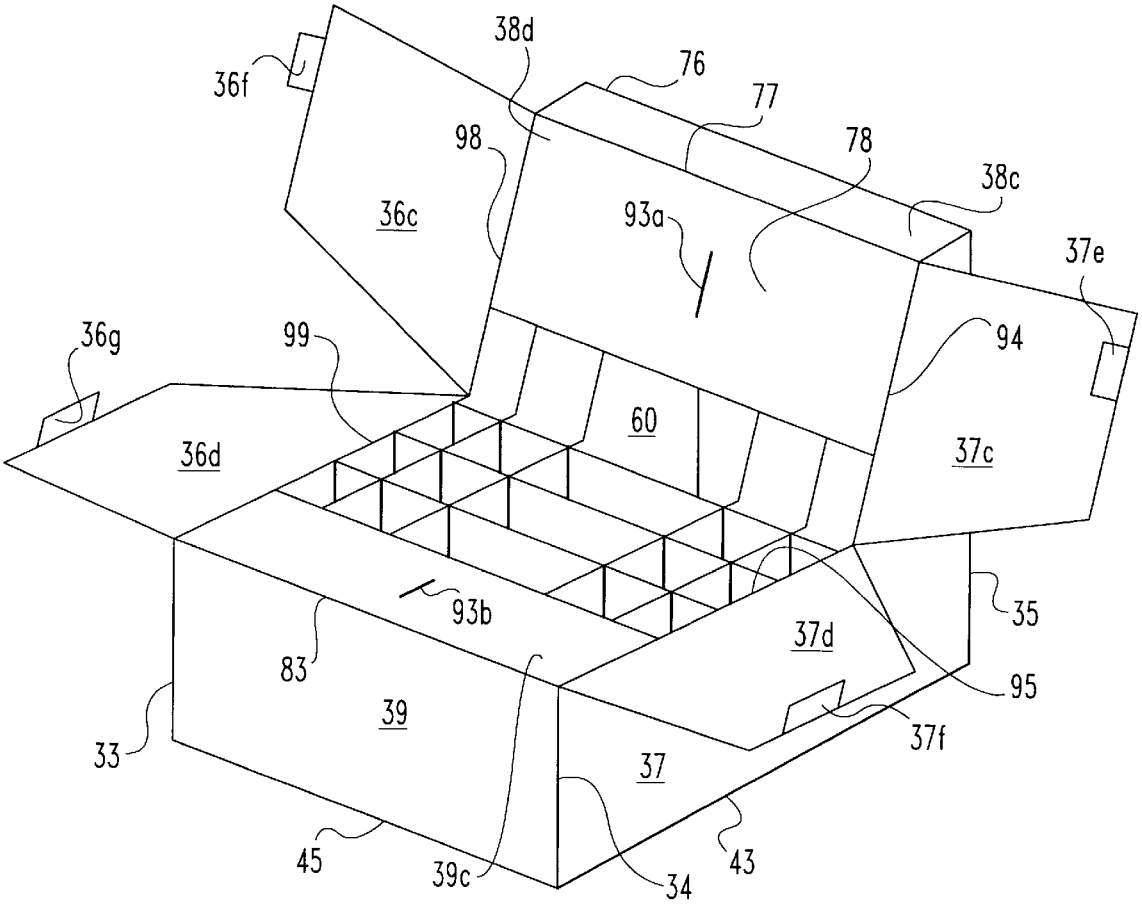

Still referring to FIGS. 2 and 8, the remainder of front section 39 is then folded into place. Front section 39 is scored in its upper marginal area along 83 to create panel 39*c* and is scored along 84 to create panel 39*d*. The marginal area of panel 39*d* has a series of slots, generally identified at 85. These slots are provided to engage core structure 59. Panel 39*d* is bent inwardly along score line 84 to a point that is perpendicular to panel 39*c*. Thereafter, panel 39*c* is bent inwardly along score line 83 to a point that is nearly perpendicular to front section 39. In so doing, panel 39*d* interfits with core structure 59 by mutually engaging slots 85 with slots 62 in L-shaped members 60. The construction of chair 30 to this point is shown in FIG. 9.

Figure 3:
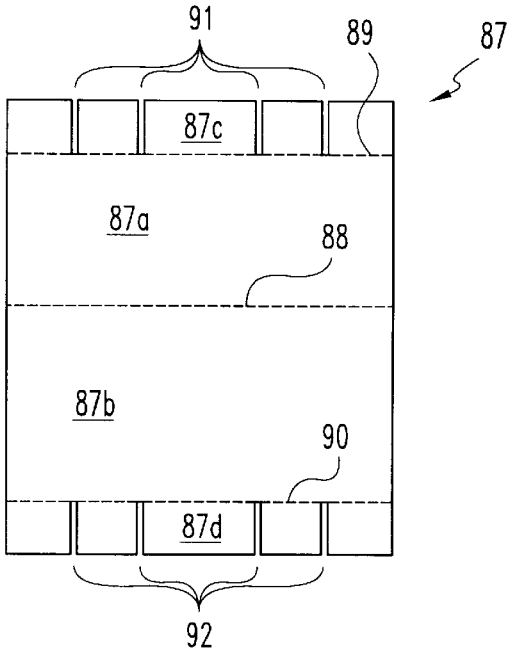
Figure 10:
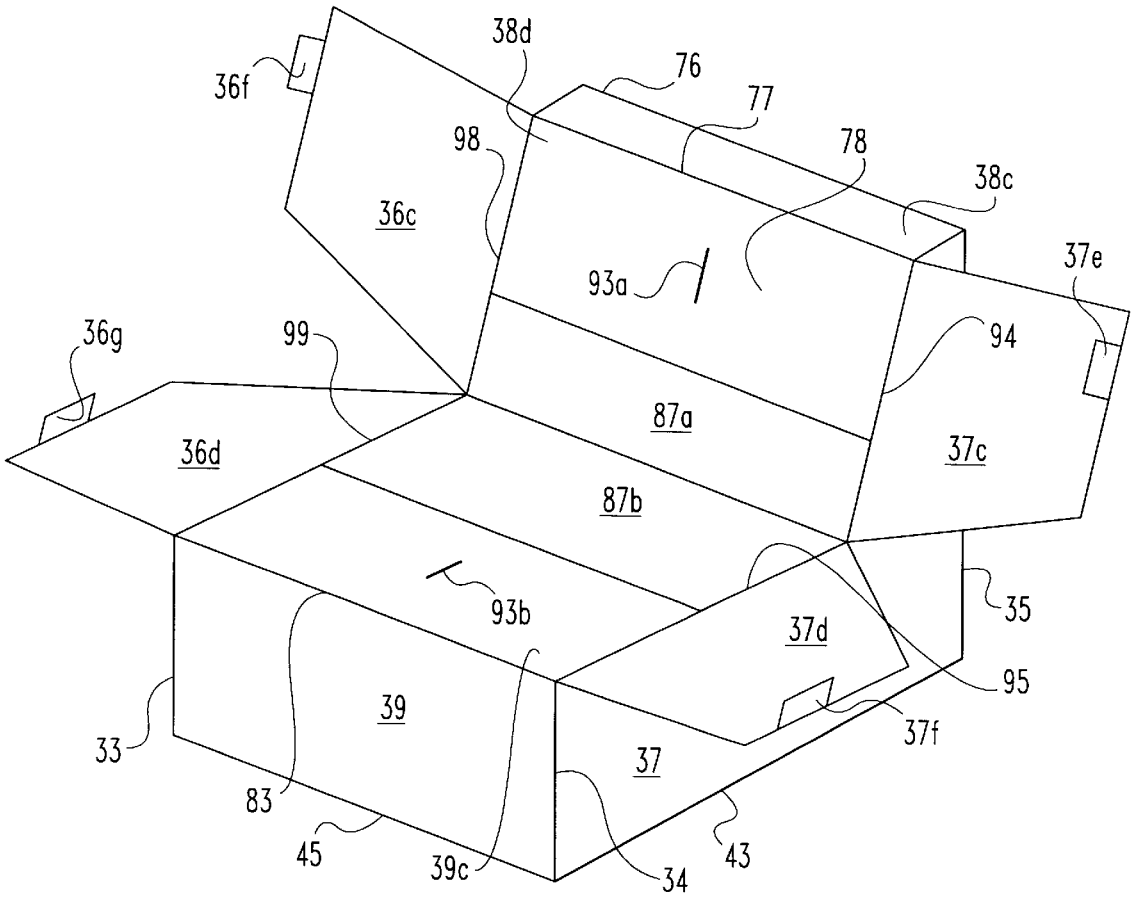

Continuing with the assembly of this example of my invention, body panel 87, shown in FIG. 3, is next installed into chair 30. Panel 87 is scored along 88 which divides panel 87 into panels 87*a* and 87*b*. Panel 87 is further scored along 89 to create panel 87*c* and along 90 to create panel 87*d*. The marginal areas of panel 87*c* and panel 87*d* have a series of slots respectively identified as 91 and 92. These slots are provided to engage core structure 59. Panel 87*c* is bent along score line 89 to a point that is nearly perpendicular to panel 87*a*. Panel 87*d* is then bent along score line 90 in the same direction as panel 87*c* and to a point that is also nearly perpendicular to panel 87*b*. Next, panel 87 is bent along 88 in the direction that is opposite of the direction that panels 87*c* and 87*d* were bent, and is bent to a point that is approximately the angle between seat area 70 and back support area 71 (shown in FIG. 5). Thusly configured, body panel 87 is then placed upon core structure 59 in chair 30, taking care to place panel 87*a* over back support area 71 and panel 87*b* over seat support area 70. In so doing, panels 87*c* and 87*d* interfit with core structure 59. In the back support area, slots 91 mutually engage slots 63 in L-shaped members 60 and, in the seat support area, slots 92 mutually engage slots 62 in L-shaped members 60. The construction of chair 30 to this point is shown in FIG. 10.

Side sections 36 and 37 are further cut to provide wings that fold over body panel 87. Referring to FIG. 2, these wings are identified as items 36*c*, 36*d*, 37*c* and 37*d*. Each side section is further scored to allow easy folding of the wings, respectively along 98, 99, 94 and 95. The chair construction continues by first folding each of the small tabs, located on the upper margins of each wing, inwardly, toward chair 30. In other words, tabs 36*f*, 36*g*, 37*e* and 37*f* are folded inwardly along their score lines 100, 101, 96 and 97 till each tab is nearly perpendicular to its wing. Next, each wing folds over and locks into the casing. For example, wing 37*c* is bent inwardly along score line 94 and over body panel 87, and in so doing, tab 37*e* inserts into slot 93*a*. The remainder of the wings are similarly installed. Wing 36*c* is folded inwardly along 98 and tab 36*f* inserts into slot 93*a*. Wing 37*d* is folded inwardly along 95 and tab 37*f* inserts into slot 93*b*, and to complete construction of this example, wing 36*d* is folded along 99 and tab 36*g* inserts into slot 93*b*.

Figure 11:
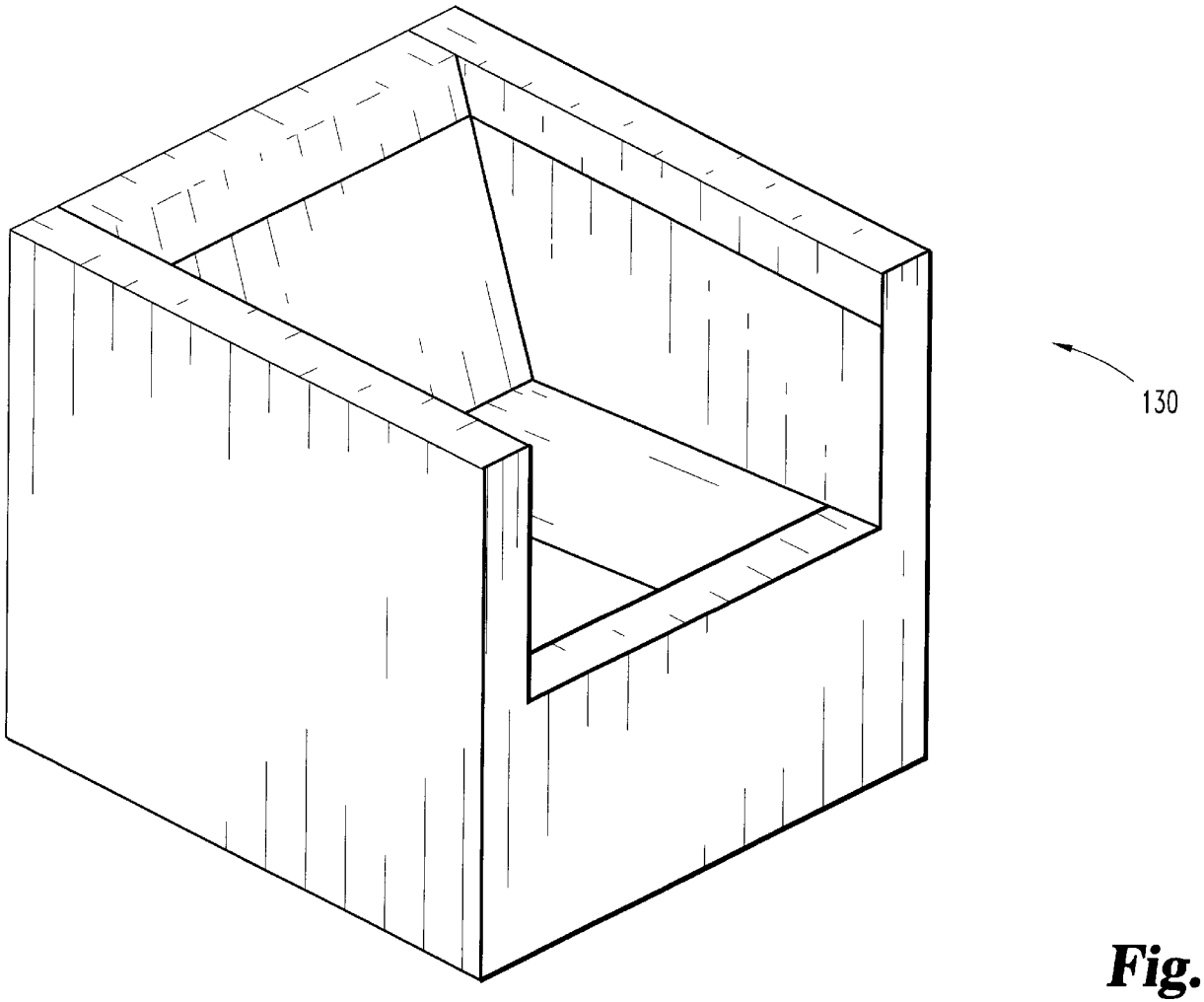
FIG. 11 is a perspective view of a completed example of my invention with arms.

Referring to FIG. 11, chair 130 is shown as another example of my invention. The construction of chair 130 begins with blank 131, shown in FIG. 12. Blank 131 folds along fold lines 132, 133, 134 and 135 to form a tube. Like chair 30, the tube formed by chair 130 is generally rectangular and is formed of side sections 136 and 137, rear section 138 and front section 139. The integrity of the tube is maintained by simply attaching tab 136*f* to free edge 140 on rear section 138 with glue, staples, or anything known in this technology that binds the particular material, and again, like chair 30, I prefer that blank 131 is triple scored at 41 and 42 for storage.

The bottom of chair 130 closes by overlapping panels just as the bottom of chair 30 was described. The same identifying numbers used in FIG. 2 are used in FIG. 12 for the reader to identify similar structures. Hence, the reader need only refer to the earlier presentation regarding the bottom of chair 30 to understand the bottom construction and assembly of chair 130.

Figure 14:
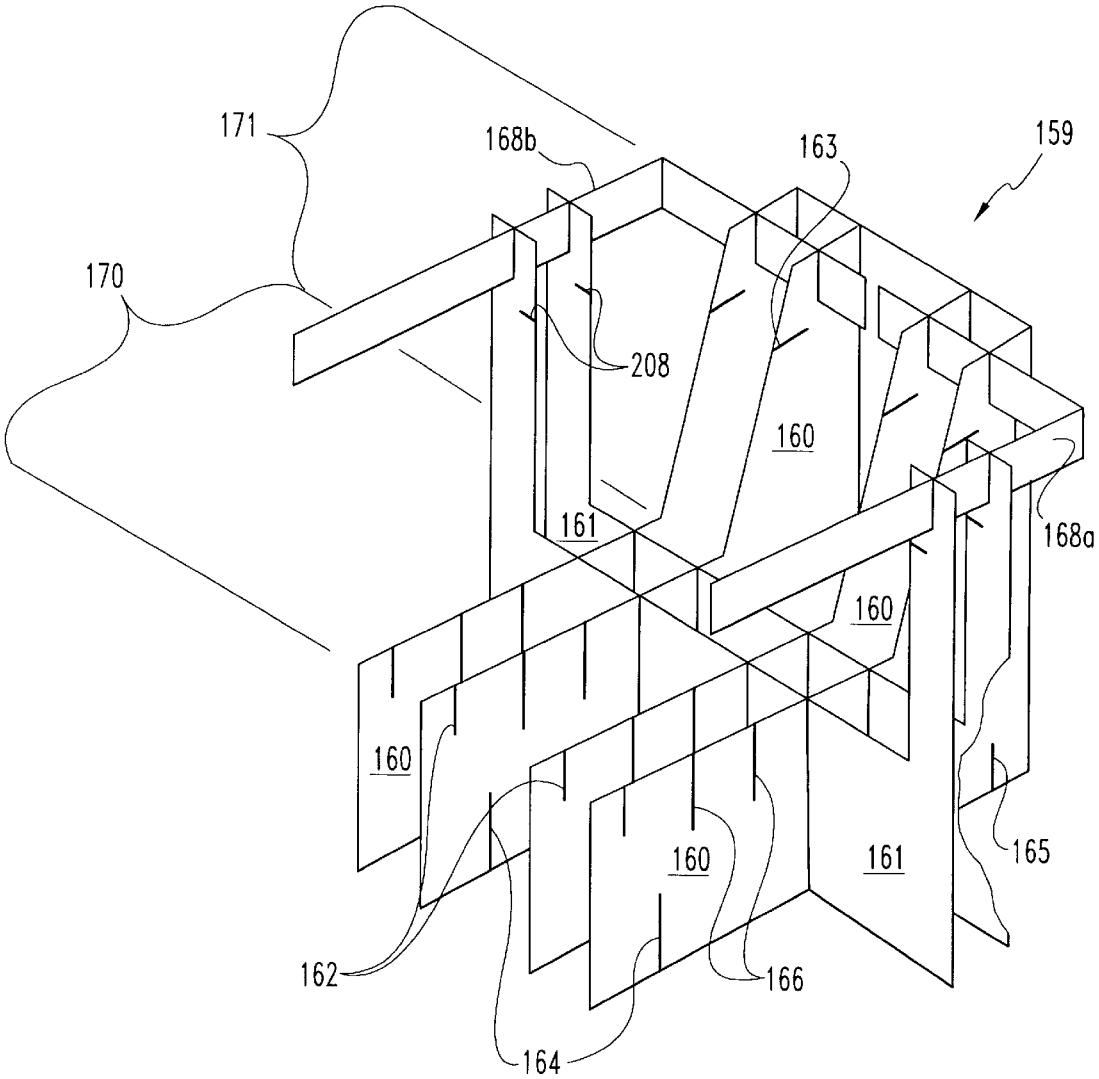
FIG. 14 is a perspective view of a partially completed core structure.
Figure 15:
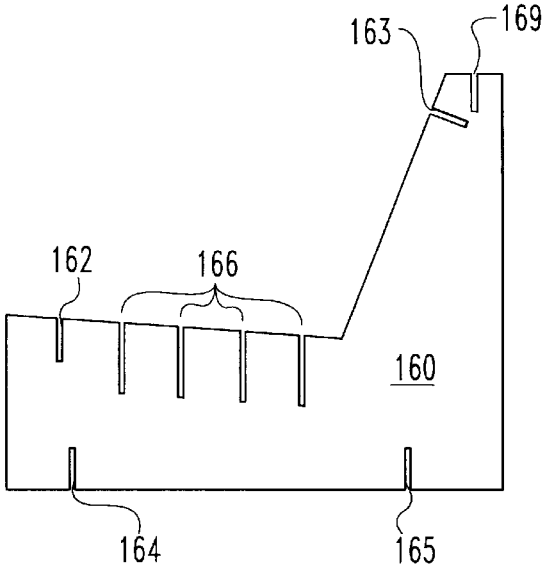

An example of the core structure for chair 130 is shown in FIG. 14 and is generally identified as 159. It includes aligned, spaced, and generally L-shaped members 160, shown in isolation in FIG. 15. Members 160 are held apart and supported by u-shaped struts 161, shown in isolation in FIG. 16. FIG. 14 shows two of the u-shaped struts removed from core structure 159 in order to convey construction details. U-shaped struts 161 have a series of slots, generally identified at 167. Referring back to FIG. 14, L-shaped members 160 interfit with struts 161 by placing struts 161 transverse to members 160 and mutually engaging slots 166 in L-shaped members 160 with slots 167 in u-shaped struts 161. Thusly held, the base legs of members 160 provide a chair seat support area, area 170, and the extending legs of members 160 provide a chair back support area, area 171. Preferably, each strut gradually increases in height with the seat as you move toward the front of the chair to provide added stability.

Installing rails 168*a* and 168*b* completes the core structure. Each rail has a series of slots, not shown. Rails 168*a* and 168*b* interfit with L-shaped members 160 and unshaped members 161 by placing rails 168*a* and 168*b* transverse to members 160 and members 161 and mutually engaging the slots in the rails (not shown) with slots 169 in the L-shaped members and slots 172 in the unshaped members, shown in FIGS. 15 and 16.

The assembly of chair 130 continues by placing core structure 159 into the casing structure. The casing structure is formed from blank 131 with its bottom closed as described earlier. Core structure 159 is then assembled or placed inside the casing structure with the extending legs of members 160 placed against rear section 138 of the casing structure. If preassembled, the core structure 159 is slowly lowered and slots 164 and 165 in L-shaped members 160 are mutually engaged with slots 49 that are located within panels 38*b* and 39*b*. The construction of chair 130 to this point is shown in FIG. 17.

Figure 12:
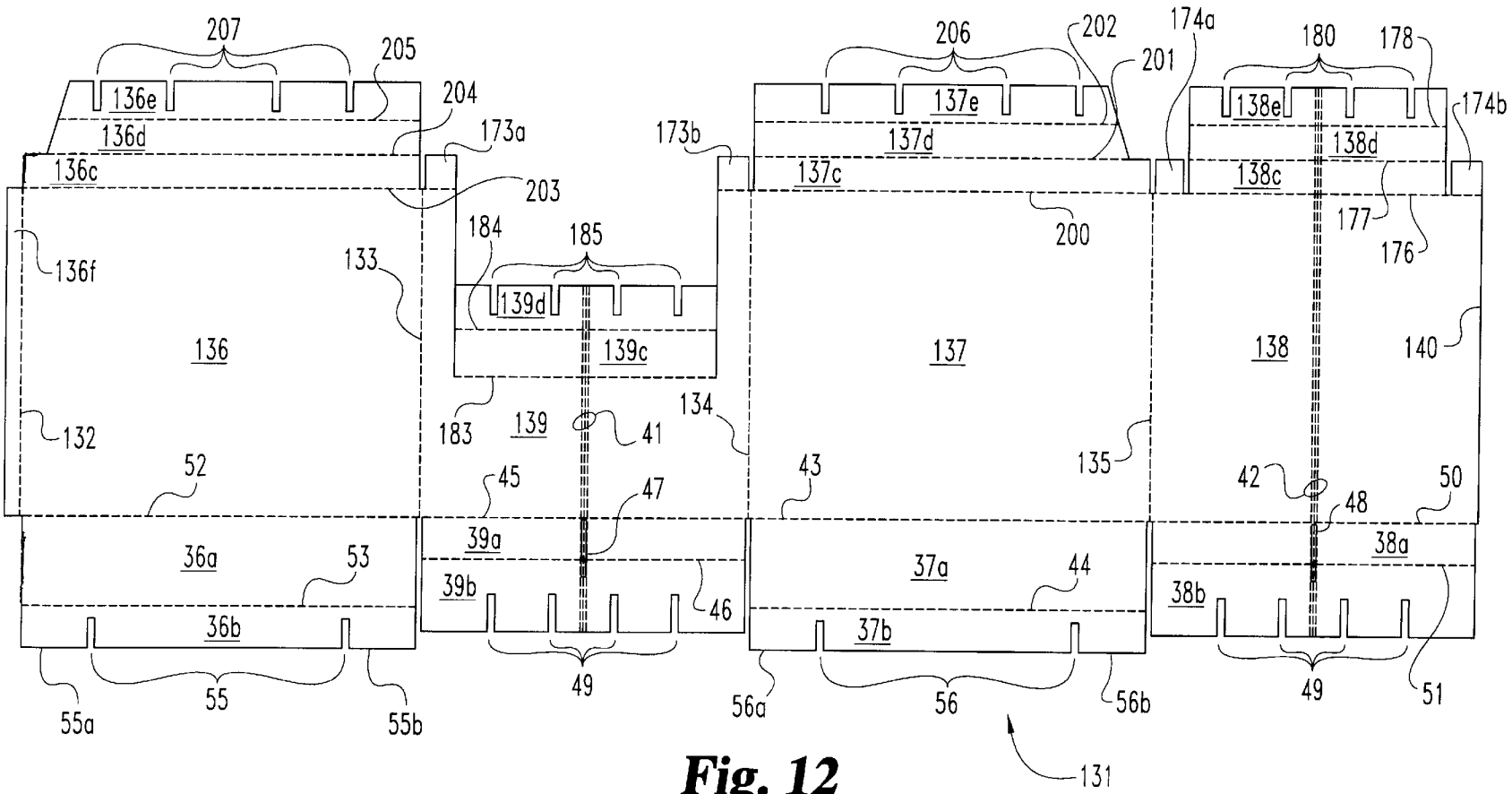
FIGS. 12, 13, 15, 16, and 21 are plan views of the blanks that are cut, scored (dashed lines), and ready for assembly to create the chair shown in FIG. 11.

Next, the top of chair 130 is closed. Referring to FIGS. 12 and 17, tabs 173*a*, 173*b*, 174*a* and 174*b* fold over core structure 159, which is followed by folding the remainder of all the sections into place. Rear section 138 is scored at 176 to create panel 138*c*, is scored at 177 to create panel 138*d*, and is scored at 178 to create panel 138*e*. The marginal area of panel 138*e* has a series of slots, generally identified at 180. These slots are provided to engage core structure 159. Panel 138*e* is first bent inwardly along score line 178 to a point that is nearly perpendicular to panel 138*d*. Next, panel 138*d* is bent inwardly along score line 177 to a point that is nearly perpendicular to panel 138*c*. Panel 138*c* is then bent inwardly along score line 176 to a point that is perpendicular to rear section 138. In so doing, panel 138*e* interfits with core structure 159 by mutually engaging slots 180 with slots 163 in L-shaped members 160.

Figure 17:
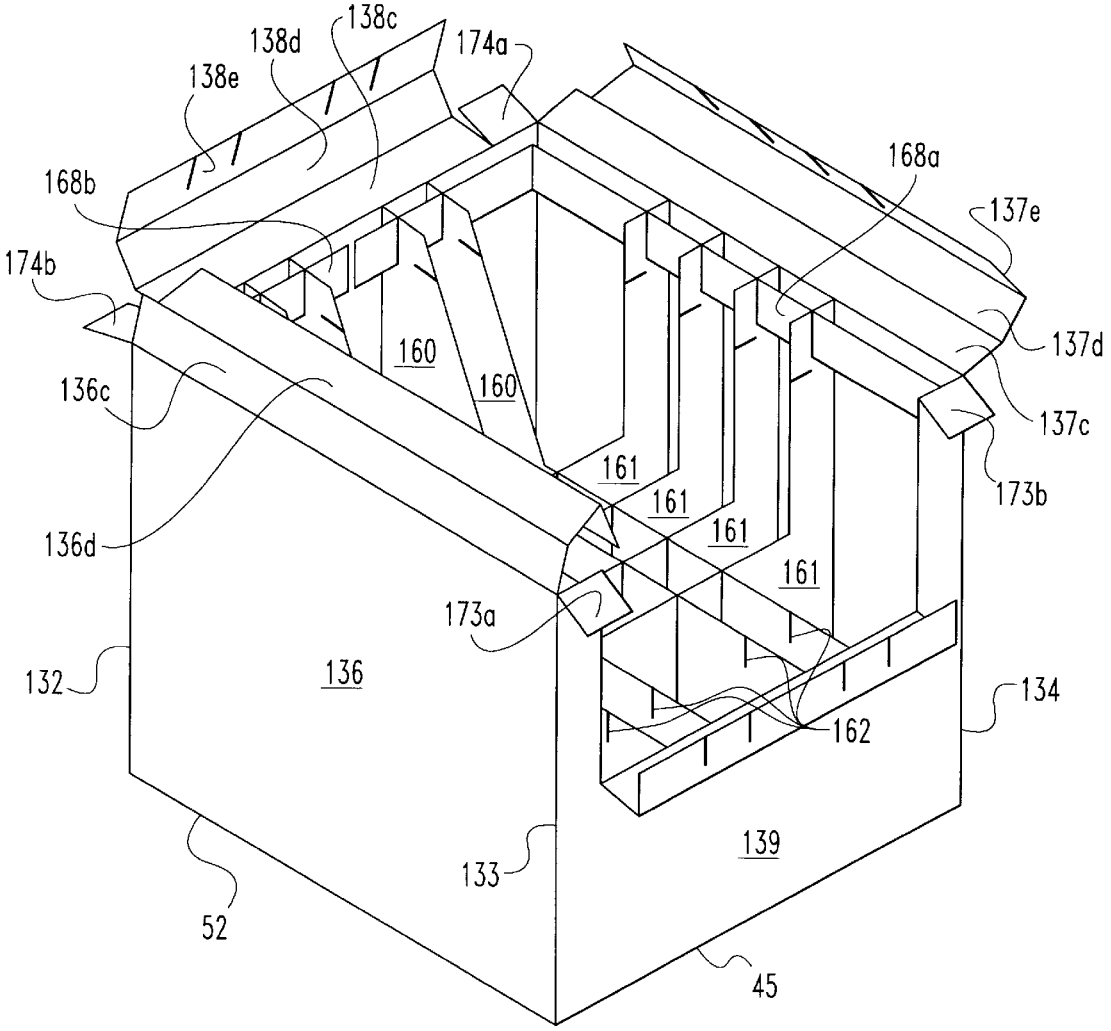
FIGS. 17 and 18 are perspective views of the partially completed chair that is shown in FIG. 11.

Still referring to FIGS. 12 and 17, the remainder of front section 139 is then folded into place. Front section 139 is scored in its upper marginal area along 183 to create panel 139*c* and is scored along 184 to create panel 139*d*. The marginal area of panel 139*d* has a series of slots, generally identified at 185. These slots are provided to engage core structure 159. Panel 139*d* is bent inwardly along score line 184 to a point that is perpendicular to panel 139*c*. Thereafter, panel 139*c* is bent inwardly along score line 183 to a point that is nearly perpendicular to front section 139. In so doing, panel 139*d* interfits with core structure 159 by mutually engaging slots 185 with slots 162 in L-shaped members 160.

The remainder of side section 137 is then folded into place. Side section 137 is scored at 200 to create panel 137*c*, is scored at 201 to create panel 137*d*, and is scored at 202 to create panel 137*e*. The marginal area of panel 137*e* has a series of slots, generally identified at 206. These slots are provided to engage core structure 159. Panel 137*e* is first bent inwardly along score line 202 to a point that is perpendicular to panel 137*d*. Next, panel 137*d* is bent inwardly along score line 201 to a point that is perpendicular to panel 137*c*. Panel 137*c* is then bent inwardly along score line 200 to a point that is perpendicular to side section 137. In so doing, panel 137*e* interfits with core structure 159 by mutually engaging slots 206 with slots 208 in u-shaped struts 161 (See FIG. 16).

Figure 18:
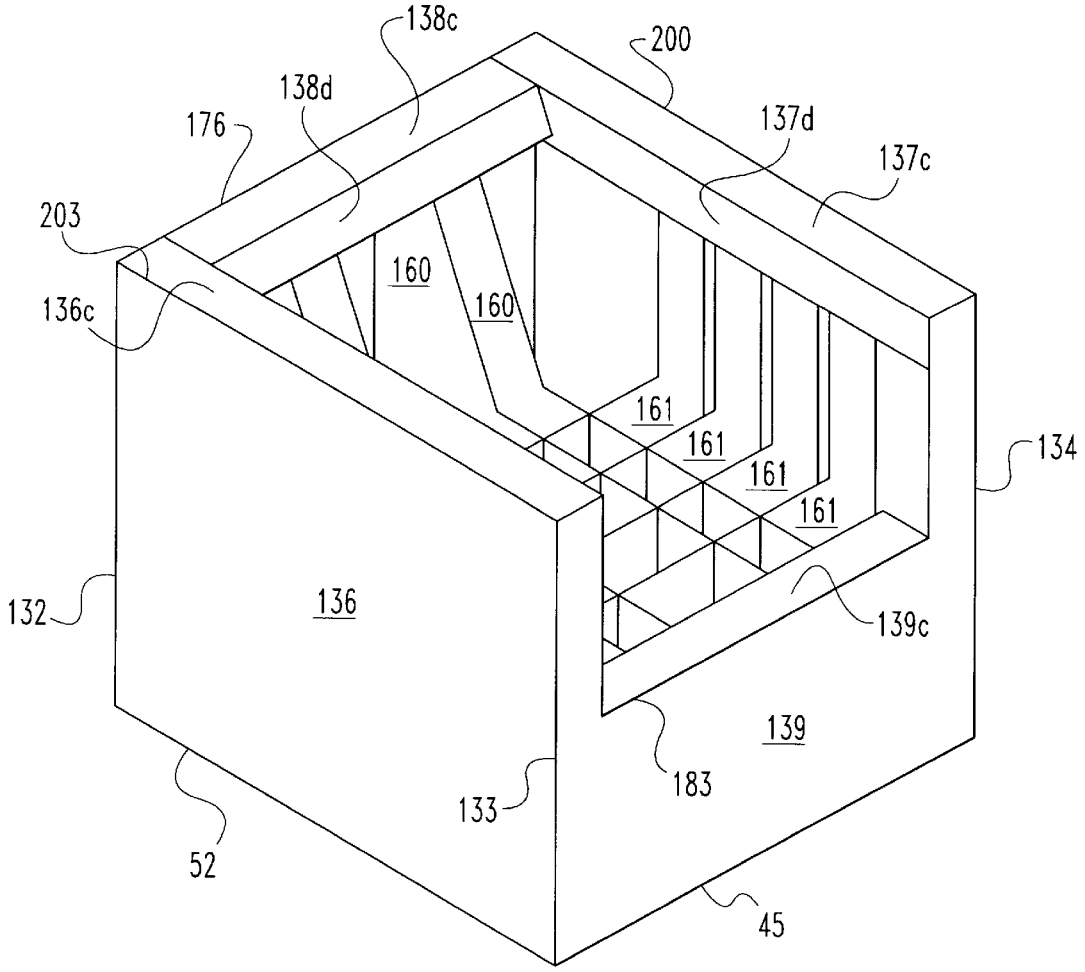

Closing the last section, the remainder of side section 136 is then folded into place. Side section 136 is scored at 203 to create panel 136*c*, is scored at 204 to create panel 136*d*, and is scored at 205 to create panel 136*e*. The marginal area of panel 136*e* has a series of slots, generally identified at 207. These slots are provided to engage core structure 159. Panel 136*e* is first bent inwardly along score line 205 to a point that is perpendicular to panel 136*d*. Next, panel 136*d* is bent inwardly along score line 204 to a point that is perpendicular to panel 136*c*. Panel 136*c* is then bent inwardly along score line 203 to a point that is perpendicular to side section 136. In so doing, panel 136*e* interfits with core structure 159 by mutually engaging slots 207 with slots 208 in unshaped struts 161 (See FIG. 16). The construction of chair 130 to this point is shown in FIG. 18.

Figure 19:
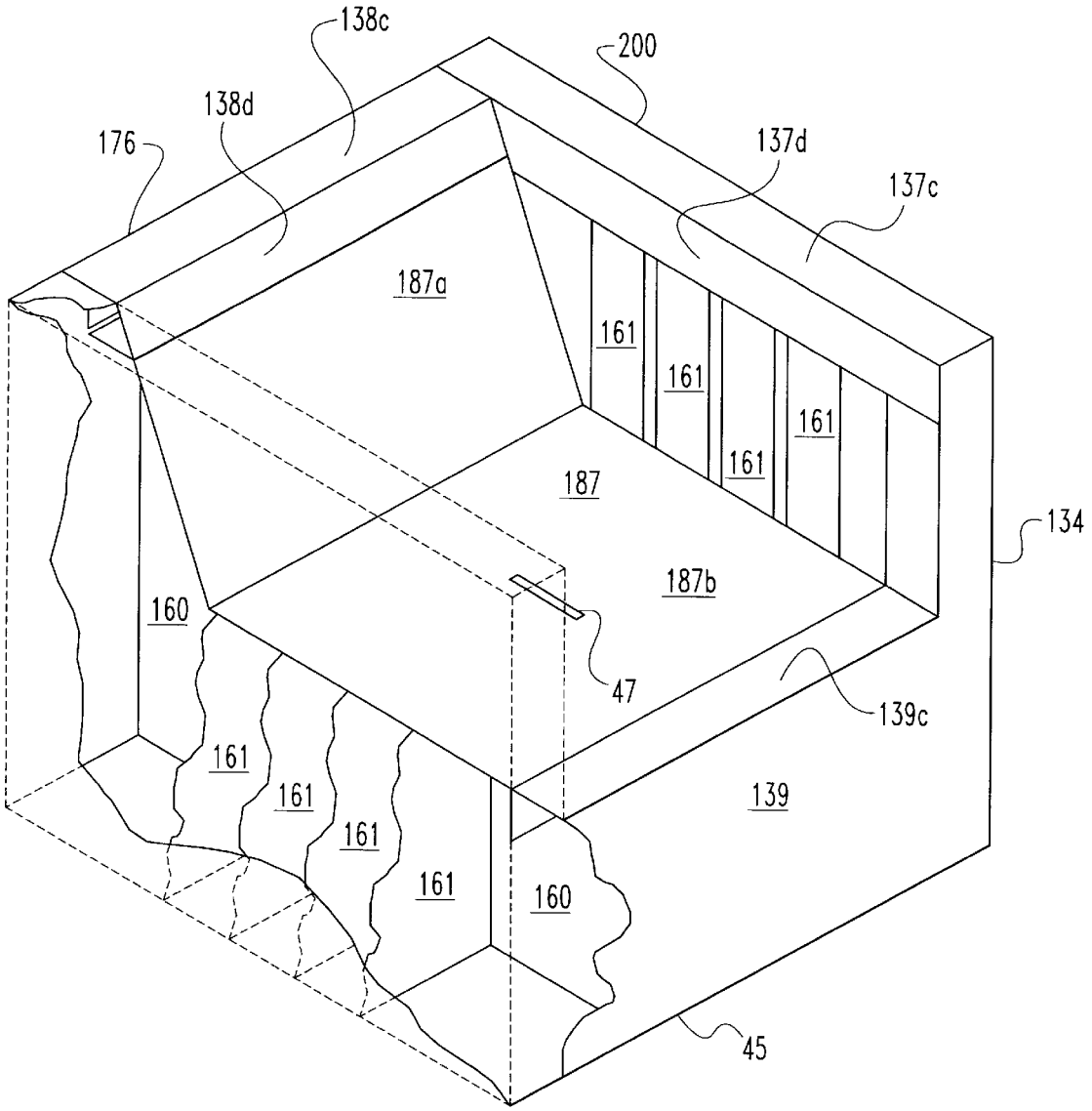
FIGS. 19 and 20 are fragmentary perspective views of the partially completed chair that is shown in FIG. 11.

Please refer now to FIG. 19, a cut away view of chair 130 with one arm removed is shown. Body panel 187, shown in isolation in FIG. 21 covers the seat and back area of the core structure. Body panel 187 is similarly installed as the installation of panel 87 was described earlier. Panel 187 is scored along 188 which divides panel 187 into panels 187*a* and 187*b*. Panel 187 is further scored along 189 to create panel 187*c* and along 190 to create panel 187*d*. The marginal areas of panel 187*c* and panel 187*d* have a series of slots respectively identified as 191 and 192. These slots are provided to engage core structure 159. Panel 187*c* is bent along score line 189 to a point that is nearly perpendicular to panel 187*a*. Panel 187*d* is then bent along score line 190 in the same direction as panel 187*c* and to a point that is also nearly perpendicular to panel 187*b*. Next, panel 187 is bent along 188 in the direction that is opposite of the direction that panels 187*c* and 187*d* were bent, and is bent to a point that is approximately the angle between seat area 170 and back support area 171 (shown in FIG. 14). Thusly configured, body panel 187 is then placed upon core structure 159 in chair 130, taking care to place panel 187*a* over back support area 171 and panel 187*b* over seat support area 170. In so doing, panels 187*c* and 187*d* interfit with core structure 159. In the back support area, slots 191 mutually engage slots 163 in L-shaped members 160, and in the seat support area, slots 192 mutually engage slots 162 in L-shaped members 160. The construction of chair 30 to this point is shown in FIG. 19.

Figure 13:
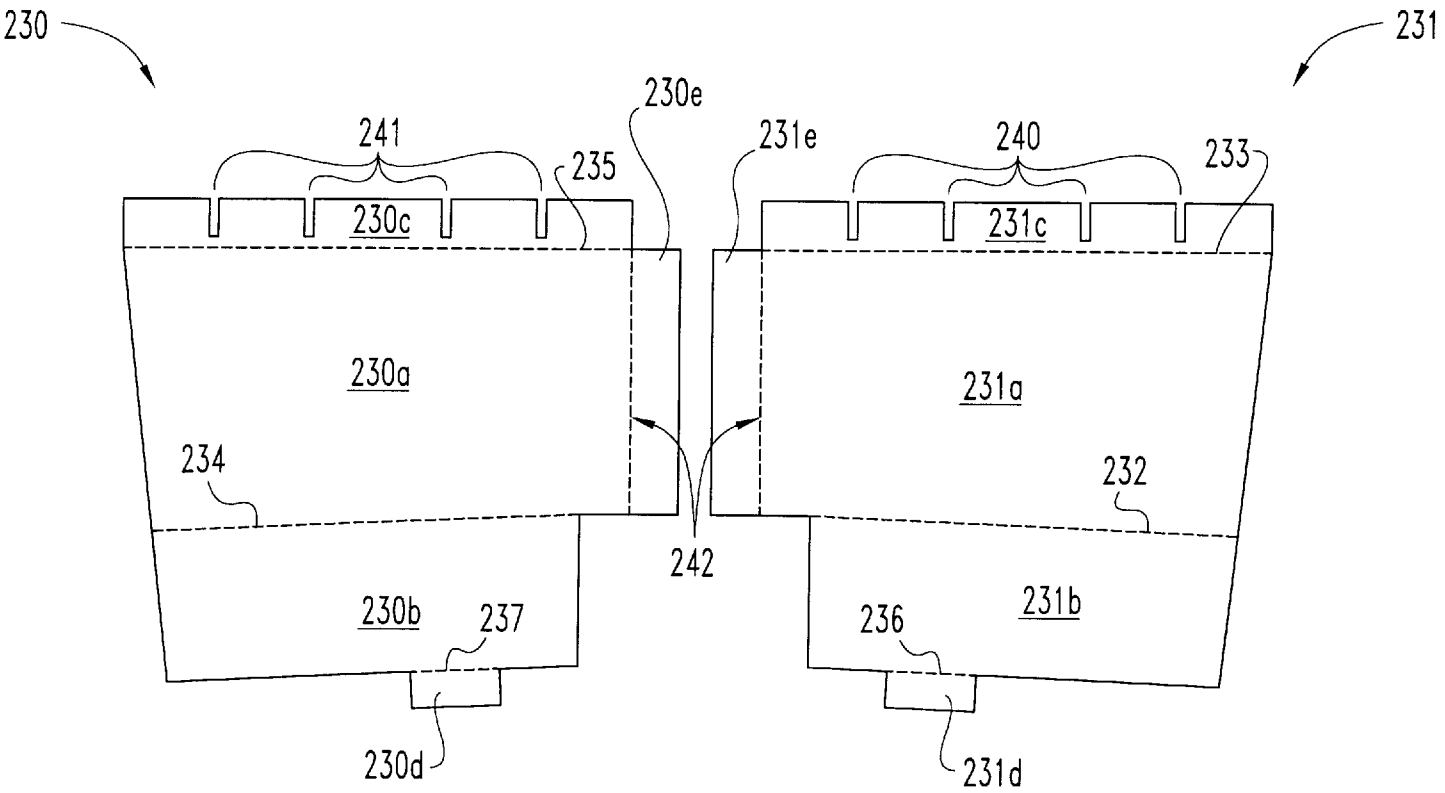
Figure 20:
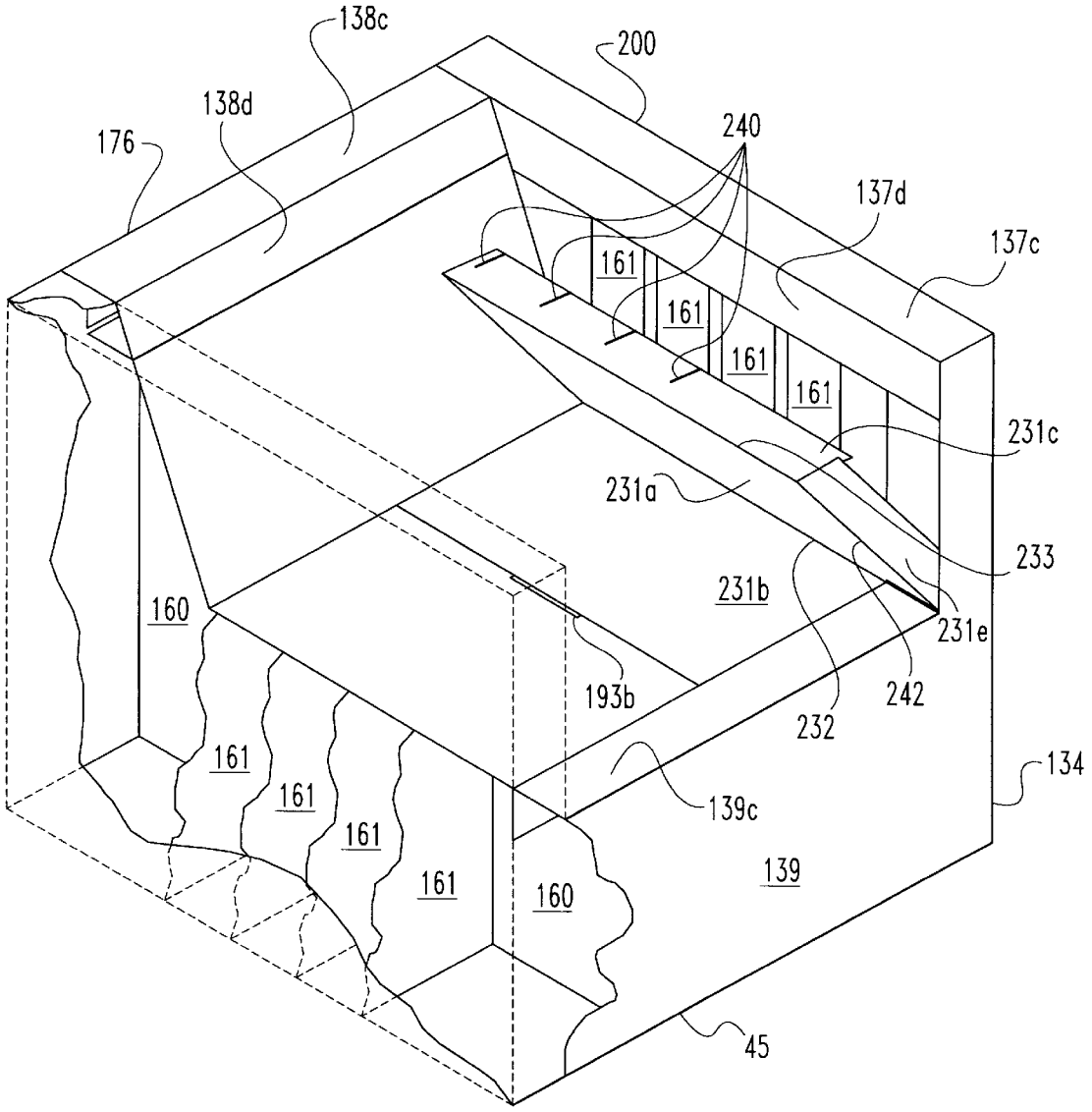
Figure 21:
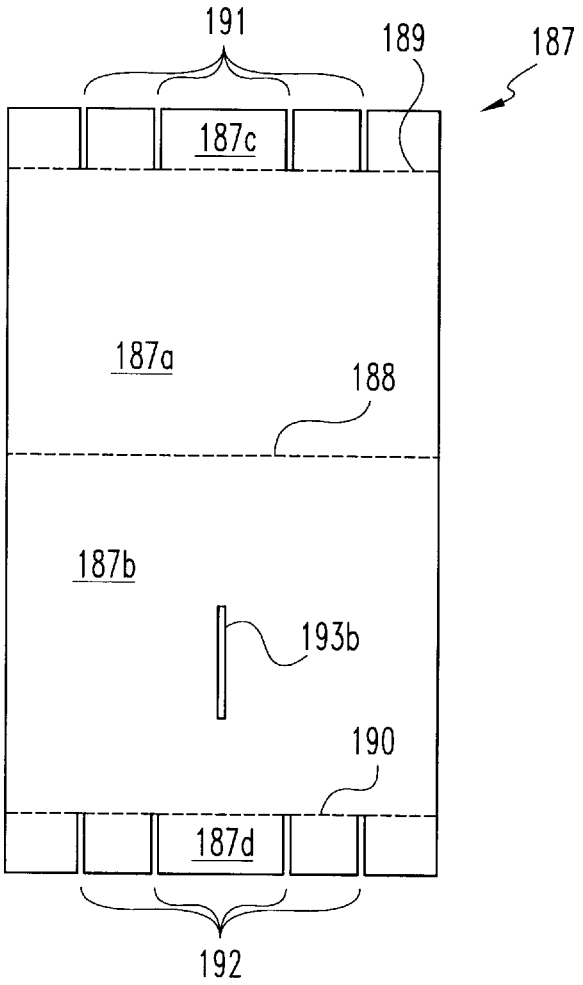

The final step to assemble chair 130 is to install internal side panels 230 and 231, shown in isolation in FIG. 13. Pagnel 231 is scored along 232 which divides panel 231 into panel 231*a* and panel 231*b*. Panel 231 is further scored along 233 to create panel 231*c*, along 236 to create tab 231*d*, and along 242 to create 231*e*. The marginal area of panel 231*c* has a series of slots 240. These slots are provided to engage core structure 159. Panel 231*c* is bent along score line 233 to a point that is perpendicular to panel 231*a*. Tab 231*d* is then bent along score line 236 in the same direction as 231*c* and is bent to a point that is perpendicular to panel 231*b*. Panel 231*e* is then bent along score line 242 in the same direction as 231*c* and is bent to a point that is perpendicular to panel 231*a*. Next, panel 231 is bent along 232 in the direction that is opposite of the direction that panels 231*c* and 231*d* were bent, and is bent to a point that places panel 231*a* perpendicular to panel 231*b*. Thusly configured, side panel 231 is then placed into chair 130, taking care to place score line 242 toward the front of chair 130. See FIG. 20. In so doing, panel 231*c* interfits with core structure 159 by mutually engaging slots 240 with slots 208 (FIG. 16) in u-shaped members 161. And panel 231*e* slides behind panel 139. Lastly, tab 231*d* is inserted into slot 193*b* within body panel 187 (FIG. 21).

Similarly, panel 230 is scored along 234 which divides panel 230 into panel 230*a* and panel 230*b*. Panel 230 is further scored along 235 to create panel 230*c*, along 237 to create tab 231*d*, and along 242 to create panel 230*e*. The marginal area of panel 230*c* has a series of slots 241. These slots are provided to engage core structure 159. Panel 230*c* is bent along score line 235 to a point that is perpendicular to panel 230*a*. Tab 230*d* is then bent along score line 237 in the same direction as 230*c* and is bent to a point that is perpendicular to panel 230*b*. Panel 230*e* is then bent along score line 242 in the same direction as 231*c* and is bent to a point that is perpendicular t panel 231*a*. Next, panel 230 is bent along 234 in the direction that is opposite of the direction that panels 230*c* and 230*d* were bent, and is bent to a point that places panel 230*a* perpendicular to panel 230*b*. Thusly configured, side panel 230 is then placed into chair 130, taking care to place score line 242 toward the front of chair 130. See FIG. 20. In so doing, panel 230*c* interfits with core structure 159 by mutually engaging slots 241 with slots 208 (FIG. 16) in u-shaped members 161. And panel 231 slides behind panel 139. Finally, placing tab 230*d* into slot 193*b* within body panel 187 (FIG. 21) completes chair 130.

Figure 22:
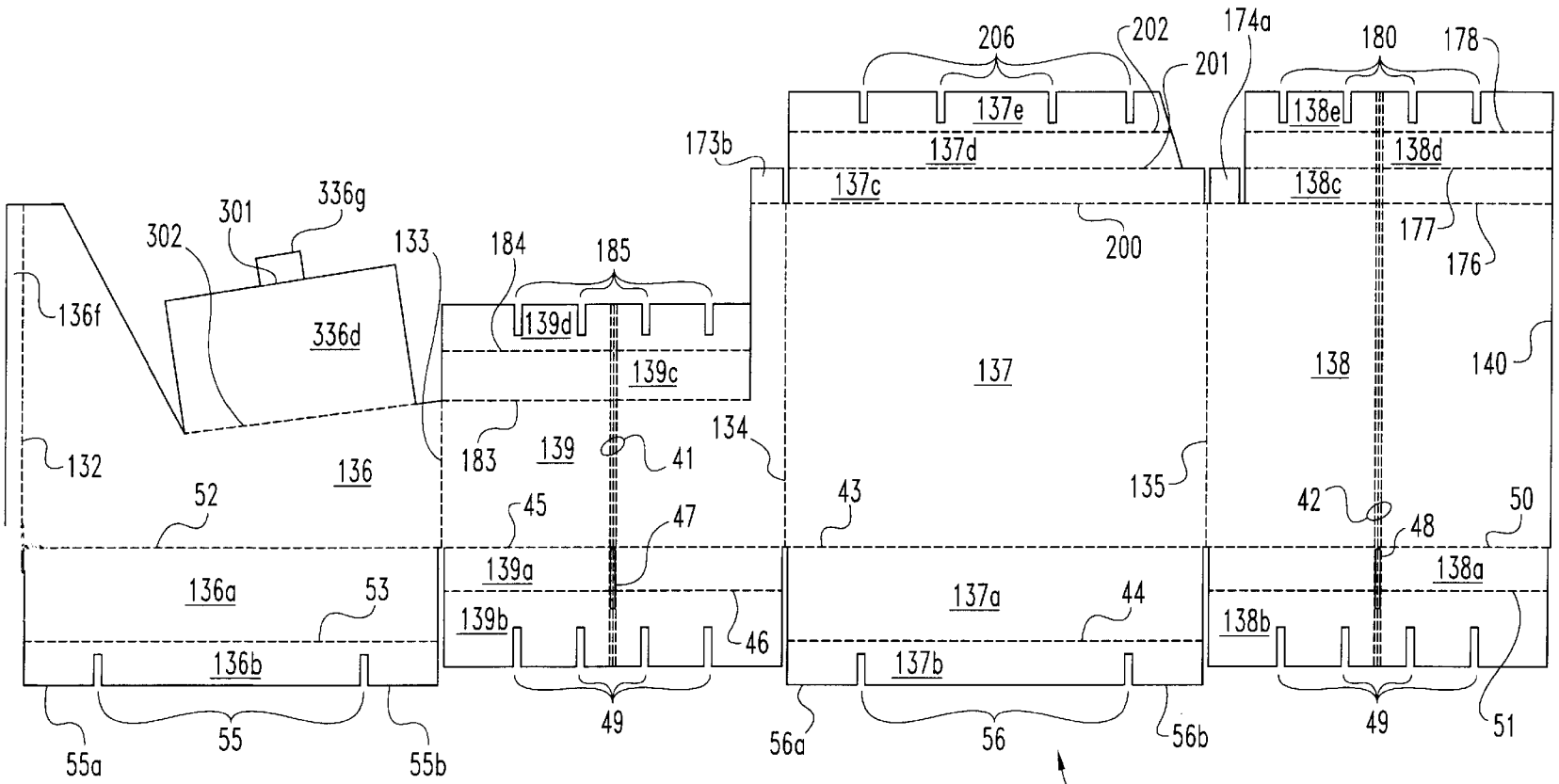
FIG. 22 is a plan view of the blank that is cut, scored (dashed lines), and ready for assembly to create a chair with a single arm.

Another example of my invention is similar to chair 130, but lacks a right or left arm support. Referring to FIG. 22, blank 231 is shown which may be used to construct an example of this one-armed version. The blank is largely identical to the blank for chair 130 with a few isolated exceptions. (1) Tab 174*b* is deleted and panels 138*e*, 138*d*, and 138*f* now extend to edge 140. (2) A portion of panel 139 is deleted and panels 139*c*, and 139*d* now extend even with score line 133. And (3), panel 136 has been changed to include new panels 336*d* and 336*g*. Mirror images of blank 231 will provide either a left-armed version or a right-armed version. In addition, one may also simply reverse the folds at 132, 133, 134, and 135 to provide a chair with the opposite arm.

The assembly of the one-armed version of my invention proceeds in the same way as the two-armed version. The same identify numbers used in FIG. 12 are used in FIG. 22 for the reader to identify similar structures. Hence, the reader need only refer to the earlier presentation regarding the assembly of the chair 130 to understand the construction and assembly of this one armed version.

Figure 16:
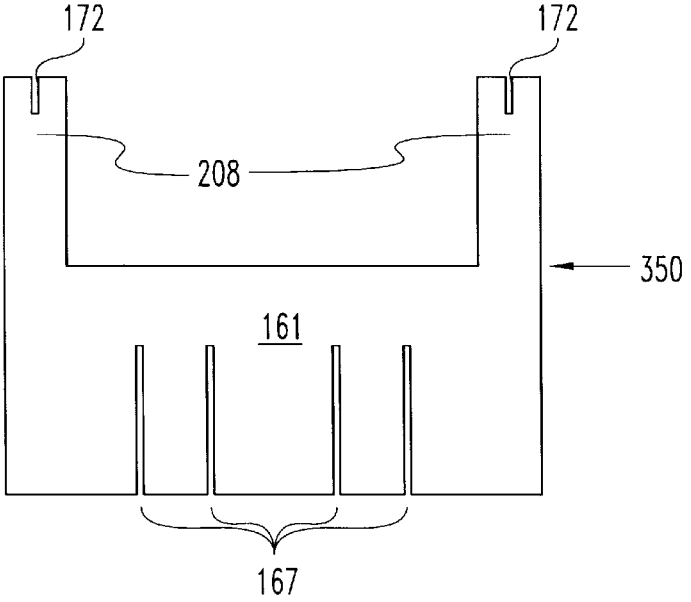

The core structure of the one-armed version requir es the u-shaped struts (FIG. 16) to be altered or replaced with L-shaped struts. An L-shaped strut is prepared by removing one of the u-shaped strut's extended legs or uprights. Referring to FIG. 16, this is done by cutting u-shaped strut at a point identified as 350. Cutting here and level with the seat support area removes the upright and creates an L-shaped strut. Of course, one may originally stamp an L-shaped strut without altering a previously stamped u-shaped strut. The core is then constructed by aligning the uprights of the L-shaped struts when the struts engage the L-shaped members 160. And locating the uprights to the side where the single arm is located.

Referring back to panel 136 in FIG. 22, panel 136 is scored at 302 to create panel 336*d*, and at 301 to create tab 336*g*. Panel 336*d* is designed to fold over body panel 187 and insert tab 336*g* into slot 193*b* of panel 187, shown in FIG. 21. But depending upon actual dimensions, panel 187 may need to be slightly wider for the one-armed version than the two-armed version. The extra width compensates for the removal of one arm by covering the now slightly wider seat and back support area. Otherwise, assembly of the one-armed version proceeds largely the same way as the assembly of the two-armed version.

One may combine several of these chairs to form a sectional couch. For example, one may place side-by-side a left-armed chair, and armless chair, and a right-armed chair to form a three-piece sectional couch. Optionally, one may insert additional armless chairs between the one-armed sections to construct even longer multi-piece sectionals.

The casing structure and core structure of my invention may be formed of any suitable relatively rigid, foldable material and are preferably made of corrugated fiberboard. At times, it may be preferable to cover all or some of the pieces with a lubricant that is appropriate for the chosen construction materials. The lubricant will act to prevent squeaking when the chair is used.

The chair structures described in this patent are lightweight and can be moved with little effort. Interlocking or interfitting the core structure with the casing makes the chairs rigid without using heavier materials. And as described earlier, both the core structure and casing can be collapsed into a relatively flat configuration after removing the core from the casing. Thusly folded, the chairs of my invention are easily stored and transported. Furthermore, a pleasing aesthetic effect may be obtained by printing the lightweight casing with a decorative pattern or simply covering the chairs with slipcovers.

While I have attempted to illustrate and describe my invention in detail, please consider these as illustrative and not restrictive of my patent rights. The reader should understand that I have only presented my preferred embodiments and that all changes and modifications that come within the spirit of my invention are included if they are described by my following claims or the legal equivalent of my claims.

I claim:

1. An article of furniture comprising a casing structure, a core structure, and a body panel, (a) the core structure further comprising aligned, spaced, generally L-shaped members having a base leg and transverse struts that extend between the L-shaped members, the L-shaped members interfitted with the transverse struts by mutually engaging slots whereby the base legs of the L-shaped members provide a seat support area and the extending legs of the L-shaped members provide a back support area, (b) the casing structure further comprising a generally rectangular tube folded from a blank of stiff sheet material that includes two side sections, a front section, and a rear section, each of the sections carrying at its lower margin a base panel that is foldable into overlapping relation to close the base of the casing structure, (c) the core structure being accommodated in the casing structure with the lower margins of the base legs of the L-shaped members adjacent the base of the casing structure, (d) the rear section carrying at its upper margin a first flap having a first slot and three lines of spaced parallel transverse score lines, the first flap folded inwardly at each of the score lines and interfitted with the core structure by mutually engaging slots, (e) the front section carrying at its upper margin a second flap having a second slot and two lines of spaced parallel transverse score lines, the second flap folded inwardly at each of the score lines and interfitted with the core structure by mutually engaging slots, (f) the side sections carrying at their upper margins a back flap with a first tab and a seat flap with a second tab, the back flaps foldable over the extending legs of the L-shaped members with the first tab engaging the first slot in the rear section and the seat flaps foldable over the base legs of the L-shaped members with the second tab engaging the second slot in the front section, (g) the body panel residing over at least a portion of the back support area and the seat support area of the core structure and further residing beneath at least a portion of the back flaps and the seat flaps of the side sections, and (h) the body panel carrying at its upper and lower margins upper and lower flaps with a score line, the upper and lower flaps folded inwardly at the score lines and interfitted with the core structure by mutually engaging slots.

2. The article of claim 1 where a lubricant resides upon at least one of the casing structure, the core structure, or the body panel.

3. The article of claim 1 where the upper flap of the body panel contacts and is tangentially aligned with the first flap of the rear section.

4. The article of claim 1 where the lower flap of the body panel contacts and is tangentially aligned with the second flap of the front section.

5. The article of claim 1 where the casing structure is printed with a decorative pattern.

6. The article of claim 1 and a decorative slip cover sized to fit the article.

7. The article of claim 1 and a seat cushion sized to cover the seat support area of the article and a back cushion sized to cover the back support area of the article.

8. The article of claim 1 where the casing structure, the core structure and the body panel are disassembled.

9. An article of furniture comprising a casing structure having a base, a core structure, a body panel, and two side panels, (a) the core structure further comprising aligned, spaced, generally L-shaped members and transverse u-shaped struts having internal sides that extend between the L-shaped members, the L-shaped members interfitted with the transverse u-shaped struts by mutually engaging slots whereby the base legs of the L-shaped members provide a seat support area and the extending legs of the L-shaped members provide a back support area, (b) the casing structure further comprising a generally rectangular tube folded from a blank of stiff sheet material that includes two side sections, a front section, and a rear section, each of the sections carrying at its lower margin a base panel that is foldable into overlapping relation to close the base of the casing structure, (c) the core structure being accommodated in the casing structure with the lower margins of the base legs of the L-shaped members adjacent the base of the casing structure, (d) the rear and side sections carrying at their upper margins respectively first and side flaps, each of the first and side flaps each having three lines of spaced parallel transverse score lines, the first and side flaps folded inwardly at each of the score lines and interfitted with the core structure by mutually engaging slots, (e) the front section carrying at its upper margin a second flap with two lines of spaced parallel transverse score lines, the second flap folded inwardly at each of the score lines and interfitted with the core structure by mutually engaging slots, (f) the body panel residing over at least a portion of the back support area and the seat support area of the core structure and having a first slot in the portion of the body panel over the seat support area, (g) the body panel carrying at its upper and lower margins upper and lower flaps with a score line, the upper and lower flaps folded inwardly at each of the score lines and interfitted with the core structure by mutually engaging slots, and (h) the side panels carrying at their bottom margins a seat flap with a first tab, the side panels positioned over the internal sides of the extending legs of the u-shaped struts, and the seat flaps extending over at least a portion of the seat support area and also extending over at least a portion of the body panel with the first tab engaging the first slot in the body panel.

10. The article of claim 9 where a lubricant resides upon at least one of the casing structure, the core structure, the body panel, and the side panels.

11. The article of claim 9 where the upper flap of the body panel contacts and is tangentially aligned with the first flap of the rear section.

12. The article of claim 9 where the lower flap of the body panel contacts and is tangentially aligned with the second flap of the front section.

13. The article of claim 9 where the c asing s tructure is printed with a decorative pattern.

14. The article of claim 9 and a decorative slip cover sized to fit the article.

15. The article of claim 9 and a seat cushion sized to cover the seat support area of the article and a back cushion sized to cover the back support area of the article.

16. The article of claim 9 where the side panels carry at their upper margins a top flap with a score line, and each of the top flaps interfits with the core structure by mutually engaging slots.

17. The article of claim 9 where the side panels carry at their side margins a side flap with a score line, and each of the side flaps are placed behind the front section of the casing structure.

18. The article of claim 9 where the casing structure, the core structure, the body panel, and the side panels are disassembled.

19. An article of furniture comprising a casing structure, having a base a core structure, a body panel, and a side panel, (a) the core structure further comprising aligned, spaced, generally L-shaped members and transverse L-shaped struts that have an internal side and that extend between the L-shaped members, the L-shaped members interfitted with the transverse L-shaped struts by mutually engaging slots whereby the base legs of the L-shaped members provide a seat support area, the extending legs of the L-shaped members provide a back support area, and the extending legs of the L-shaped struts provide an arm support area, (b) the casing structure further comprising a generally rectangular tube folded from a blank of stiff sheet material that includes an armless side section, an armed side section, a front section, and a rear section, each of the sections carrying at its lower margin a base panel that is foldable into overlapping relation to close the base of the casing structure, (c) the core structure being accommodated in the casing structure with the lower margins of the base legs of the L-shaped members adjacent the base of the casing structure, and with the outer margins of the extending legs of the L-shaped struts adjacent the armed side section, (d) the rear section and the armed side section carrying at their upper margins respectively first and side flaps, each of the first and side flaps each having three lines of spaced parallel transverse score lines, the first and side flaps folded inwardly at each of the score lines and interfitted with the core structure by mutually engaging slots, (e) the front section carrying at its upper margin a second flap with two lines of spaced parallel transverse score lines, the second flap folded inwardly at each of the score lines and interfitted with the core structure by mutually engaging slots, (f) the body panel residing over at least a portion of the back support area and the seat support area of the core structure and having a first slot in the portion of the body panel over the seat support area, (g) the body panel carrying at its upper and lower margins upper and lower flaps with a score line, the upper and lower flaps folded inwardly at each of the score lines and interfitted with the core structure by mutually engaging slots, (h) the side panel carrying at its bottom margin a seat flap with a first tab, the side panel positioned over the internal side of the extending legs of the L-shaped struts, and the seat flap extending over at least a portion of the seat support area, and also extending over at least a portion of the body panel with the first tab engaging the first slot in the body panel, and (i) The armless side section carrying at its upper margin a seat flap with a second tab, the seat flap foldable over the base legs of the L-shaped members with the second tab engaging the first slot in the body panel.

20. The article of claim 19 where a lubricant resides upon at least one of the casing structure, the core structure, the body panel, and the side panel.

21. The article of claim 19 where the upper flap of the body panel contacts and is tangentially aligned with the first flap of the rear section.

22. The article of claim 19 where the lower flap of the body panel contacts and is tangentially aligned with the second flap of the front section.

23. The article of claim 19 where the casing structure is printed with a decorative pattern.

24. The article of claim 19 and a decorative slip cover sized to fit the article.

25. The article of claim 19 and a seat cushion sized to cover the seat support area of the article and a back cushion sized to cover the back support area article.

26. The article of claim 19 where the side panel carries at its upper margin a top flap with a score line, and the top flap interfits with the core structure by mutually engaging slots.

27. The article of claim 19 where the side panel carries at its side margin a side flap with a score line, and the side flap is placed behind the front section of the casing structure.

28. The article of claim 19 when the casing structure, the core structure, the body panel, and the side panel are disassembled.

29. A sectional couch comprising at least one article of furniture that includes a casing structure, a core structure, and a body panel, (a) the core structure further comprising aligned, spaced, generally L-shaped members having a base leg and transverse struts that extend between the L-shaped members, the L-shaped members interfitted with the transverse struts by mutually engaging slots whereby the base legs of the L-shaped members provide a seat support area and the extending legs of the L-shaped members provide a back support area, (b) the casing structure further comprising a generally rectangular tube folded from a blank of stiff sheet material that includes two side sections, a front section, and a rear section, each of the sections carrying at its lower margin a base panel that is foldable into overlapping relation to close the base of the casing structure, (c) the core structure being accommodated in the casing structure with the lower margins of the base legs of the L-shaped members adjacent the base of the casing structure, (d) the rear section carrying at its upper margin a first flap having a first slot and three lines of spaced parallel transverse score lines, the first flap folded inwardly at each of the score lines and interfitted with the core structure by mutually engaging slots, (e) the front section carrying at its upper margin a second flap having a second slot and two lines of spaced parallel transverse score lines, the second flap folded inwardly at each of the score lines and interfitted with the core structure by mutually engaging slots, (f) the side sections carrying at their upper margins a back flap with a first tab and a seat flap with a second tab, the back flaps foldable over the extending legs of the L-shaped members with the first tab engaging the first slot in the rear section and the seat flaps foldable over the base legs of the L-shaped members with the second tab engaging the second slot in the front section, (g) the body panel residing over at least a portion of the back support area and the seat support area of the core structure and further residing beneath at least a portion of the back flaps and the seat flaps of the side sections, and (h) the body panel carrying at its upper and lower margins upper and lower flaps with a score line, the upper and lower flaps folded inwardly at the score lines and interfitted with the core structure by mutually engaging slots and at least another article of furniture that includes a casing structure, a core structure, a body panel, and a side panel, (a) the core structure further comprising aligned, spaced, generally L-shaped members and transverse L-shaped struts that have an internal side and that extend between the L-shaped members, the L-shaped members interfitted with the transverse L-shaped struts by mutually engaging slots whereby the base legs of L-shaped members provide a seat support area, the extending legs of the L-shaped members provide a back support area, and the extending legs of the L-shaped struts provide an arm support area, (b) the casing structure further comprising a generally rectangular tube folded from a blank of stiff sheet material that includes an armless side section, an armed side section, a front section, and a rear section, each of the sections carrying at its lower margin a base panel that is foldable into overlapping relation to close the base of the casing structure, (c) the core structure being accommodated in the casing structure with the lower margins of the base legs of the L-shaped members adjacent the base of the casing structure, and with the outer margins of the extending legs of the L-shaped struts adjacent the armed side section, (d) the rear section and the armed side section carrying at their upper margins respectively first and side flaps, each of the first and side flaps each having three lines of spaced parallel transverse score lines, the first and side flaps folded inwardly at each of the score lines and interfitted with the core structure by mutually engaging slots, (e) the front section carrying at its upper margin a second flap with two lines of spaced parallel transverse score lines, the second flap folded inwardly at each of the score lines and interfitted with the core structure by mutually engaging slots, (f) the body panel residing over at least a portion of the back support area and the seat support area of the core structure and having a first slot in the portion of the body panel over the seat support area, (g) the body panel carrying at its upper and lower margins upper and lower flaps with a score line, the upper and lower flaps folded inwardly at each of the score lines and interfitted with the core structure by mutually engaging slots, (h) the side panel carrying at its bottom margin a seat flap with a first tab, the side panel positioned over the internal side of the extending legs of the L-shaped struts, and the seat flap extending over at least a portion of the seat support area, and also extending over at least a portion of the body panel with the first tab engaging the first slot in the body panel, and (i) the armless side section carrying at its upper margin a seat flap with a second tab, the seat flap foldable over the base legs of the L-shaped members with the second tab engaging the first slot in the body panel.

30. The sectional couch of claim 29 where the casing structure of at least one article of furniture is printed with a decorative pattern.

31. The sectional couch of claim 29 and a decorative slip cover sized to fit the sectional couch.

32. The sectional couch of claim 29 and one or more seat cushions that cover substantially all of the seat support area provided by the articles of furniture.

33. The sectional couch of claim 29 and one or more back cushions that cover substantially all of the back support area provided by the articles of furniture.

* * * * *

UNITED STATES PATENT AND TRADEMARK OFFICE

CERTIFICATE OF CORRECTION

PATENT NO. : 5,860,704

DATED : January 19, 1999

INVENTOR(S) : E. Dallas Smith

It is certified that error appears in the above-indentified patent and that said Letters Patent is hereby corrected as shown below:

On the title page,

At section [75] "Indianapolis," should read –Greencastle–.
In column 2, line 47, please change "unshaped" to –u-shaped–.
In column 7, line 26, please change "unshaped" to –u-shaped–.
In column 7, lines 30, please change "unshaped" to –u-shaped–.
In column 8, line 32, please change "unshaped" to –u-shaped–.

In column 8, line 64, please change "Pagnel" to –Panel–.

In column 9, line 63, please change "requir es" to –requires–.

In column 12, line 41, please change "c asing s tructure" to –casing structure–.

Signed and Sealed this

Sixteenth Day of November, 1999

*Attest:*

Q. TODD DICKINSON

*Attesting Officer*

*Acting Commissioner of Patents and Trademarks*